US009776696B2

(12) United States Patent
Ariga

(10) Patent No.: US 9,776,696 B2
(45) Date of Patent: Oct. 3, 2017

(54) PROPELLER FOR VESSEL PROPULSION APPARATUS AND VESSEL PROPULSION APPARATUS INCLUDING THE SAME

(71) Applicant: YAMAHA HATSUDOKI KABUSHIKI KAISHA, Iwata-shi, Shizuoka (JP)

(72) Inventor: Koma Ariga, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 311 days.

(21) Appl. No.: 14/684,724

(22) Filed: Apr. 13, 2015

(65) Prior Publication Data

US 2015/0336647 A1 Nov. 26, 2015

(30) Foreign Application Priority Data

May 20, 2014 (JP) ..... 2014-104634

(51) Int. Cl.

| | |
|---|---|
| ***B63H 1/15*** | (2006.01) |
| ***B63H 1/20*** | (2006.01) |
| ***B63H 23/34*** | (2006.01) |
| ***B63H 1/14*** | (2006.01) |

(52) U.S. Cl.

CPC ..... *B63H 1/15* (2013.01); *B63H 1/14* (2013.01); *B63H 1/20* (2013.01); *B63H 23/34* (2013.01); *B63H 2023/342* (2013.01)

(58) Field of Classification Search

CPC ... B63H 1/15; B63H 1/14; B63H 1/20; B63H 23/34; B63H 2023/342; F16D 3/12; F16D 3/18

See application file for complete search history.

(56) References Cited

U.S. PATENT DOCUMENTS

| | | | | |
|---|---|---|---|---|
| 3,865,509 | A | 2/1975 | Frazzell et al. | |
| 7,717,678 | B2 * | 5/2010 | Chen | B63H 1/14 416/134 R |
| 8,419,489 | B2 * | 4/2013 | Tsunekawa | B63H 20/14 416/134 R |
| 2007/0053777 | A1 | 3/2007 | Harada | |
| 2011/0212657 | A1 | 9/2011 | Tsunekawa et al. | |
| 2014/0205455 | A1 | 7/2014 | Kuroki | |

FOREIGN PATENT DOCUMENTS

| | | |
|---|---|---|
| EP | 1 219 534 A2 | 7/2002 |

OTHER PUBLICATIONS

Official Communication issued in corresponding European Patent Application No. 15168384.4 dated Oct. 9, 2015.

* cited by examiner

*Primary Examiner* — Dwayne J White
*Assistant Examiner* — Peter T Hrubiec
(74) *Attorney, Agent, or Firm* — Keating and Bennett, LLP

(57) ABSTRACT

A propeller includes a bushing that rotates together with the propeller shaft, and a propeller damper disposed around the bushing, and an inner cylinder that surrounds the bushing via the propeller damper. The bushing includes a first cylindrical portion surrounding the propeller shaft, and a first protrusion protruding outward from the first cylindrical portion and integral with the first cylindrical portion. The inner cylinder includes a second cylindrical portion surrounding the bushing via the propeller damper and a second protrusion protruding inward from the second cylindrical portion. The inner cylinder is rotatable with respect to the bushing between a noncontact position and a contact position.

27 Claims, 11 Drawing Sheets

FIG. 8A ROTARY TORQUE : 0 OPERATING ANGLE : 0
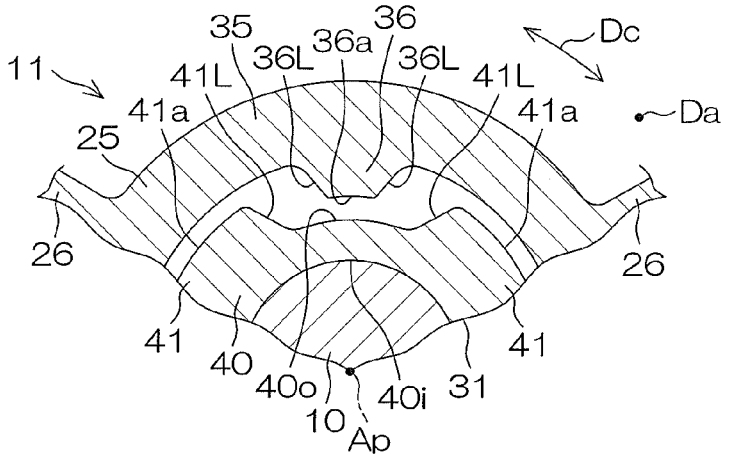
FIG. 8B ROTARY TORQUE : 0 OPERATING ANGLE : 0
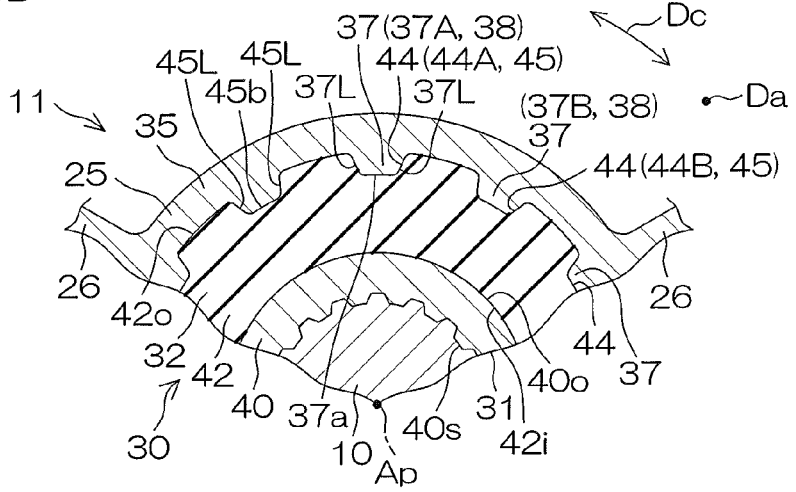
FIG. 8C ROTARY TORQUE : 0 OPERATING ANGLE : 0
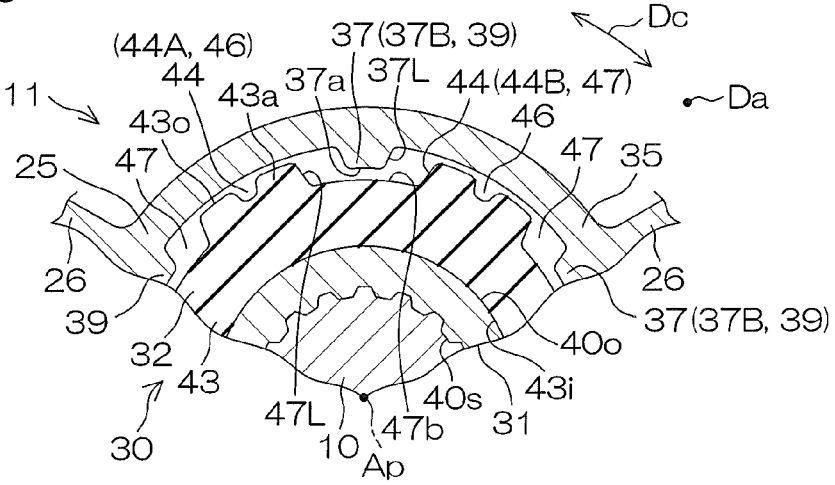

FIG. 9
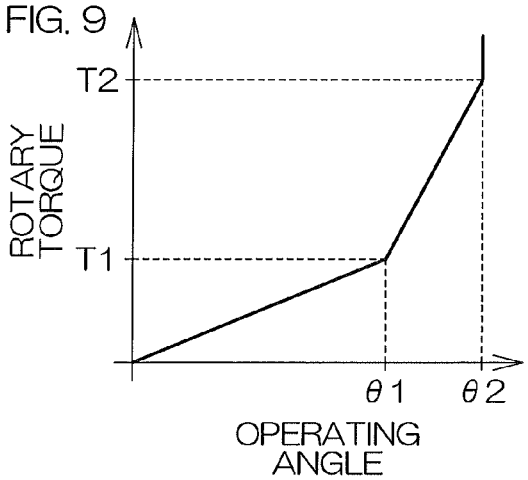
FIG. 10A ROTARY TORQUE : FIRST TORQUE T1
OPERATING ANGLE : θ1
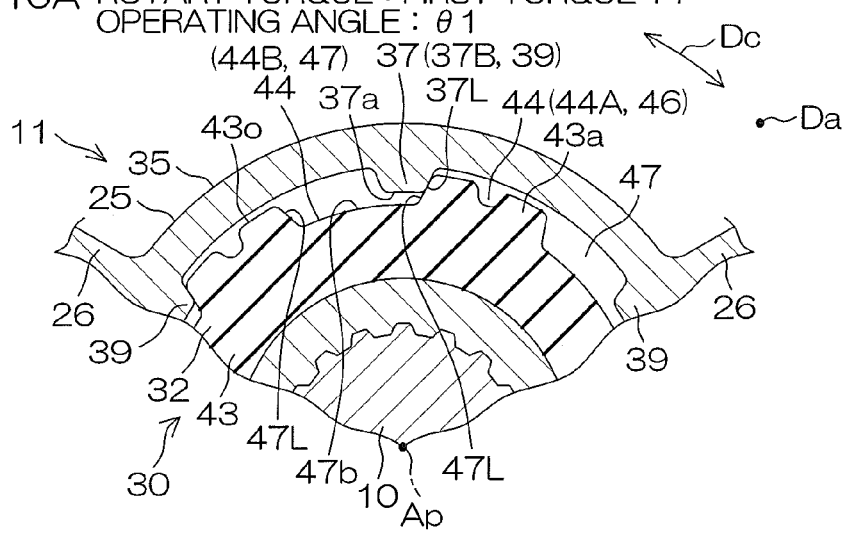
FIG. 10B ROTARY TORQUE : SECOND TORQUE T2
OPERATING ANGLE : θ2
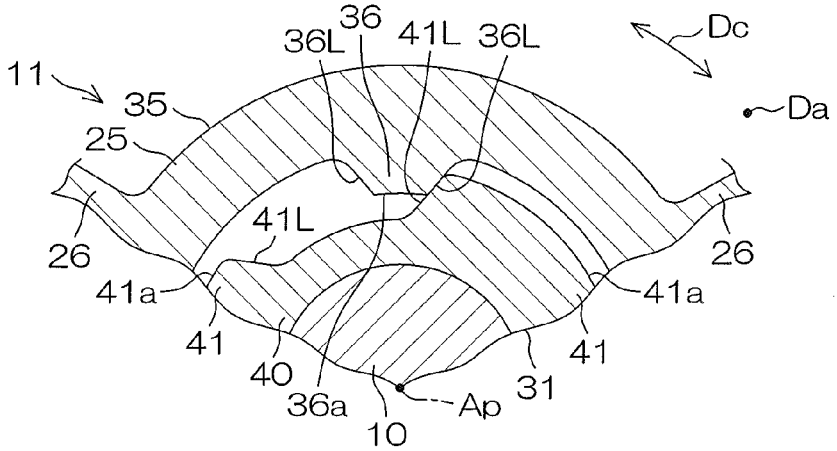

PROPELLER FOR VESSEL PROPULSION APPARATUS AND VESSEL PROPULSION APPARATUS INCLUDING THE SAME

BACKGROUND OF THE INVENTION

1. Field of the Invention

The present invention relates to a propeller for a vessel propulsion apparatus that propels a vessel and a vessel propulsion apparatus including the same.

2. Description of the Related Art

A vessel propulsion apparatus such as an outboard motor generates thrust by rotating a propeller member provided with a plurality of blades.

The propeller member may be attached to a propeller shaft via a propeller damper that is elastically deformable. The propeller damper transmits a torque between the propeller member and the propeller shaft, and absorbs a shock between the propeller member and the propeller shaft. A shock (soft shock) caused by connection or disconnection of a dog clutch and a shock caused by a collision between the propeller member and an obstacle in water are absorbed by the propeller damper.

U.S. Patent Application Publication No. 2011/212657 A1 discloses an outboard motor including a propeller. The propeller includes a bushing spline-coupled to the propeller shaft, a propeller damper (main and sub dampers) disposed around the bushing, and a propeller member surrounding the bushing via the propeller damper. The bushing is disposed between a front spacer and a rear spacer surrounding the propeller shaft. The front spacer, the bushing, and the rear spacer are fixed to the propeller shaft by a nut attached to the propeller shaft.

When the propeller shaft is driven to rotate by an engine while the propeller is in water, the propeller damper elastically deforms, and the propeller member and the propeller shaft rotate relative to each other by an angle corresponding to the deformation amount. Then, when the elastic deformation amount of the propeller damper reaches a predetermined value, teeth provided on the rear spacer come into contact with the inner surfaces of the notches provided on the inner cylinder of the propeller member, and the propeller member and the propeller shaft rotate integrally. Accordingly, a torque is efficiently transmitted from the propeller shaft to the propeller member.

One of the indexes showing performance of the propeller damper is a maximum operating angle (maximum value of an operating angle). The operating angle is an elastic deformation amount of the propeller damper in the circumferential direction (relative rotation angle of the propeller member and the propeller shaft) when a torque to rotate the propeller member and the propeller shaft relative to each other is generated. The larger the maximum operating angle is, the larger the allowable relative rotation of the propeller member and the propeller shaft is, so that the function to absorb a shock caused by torque fluctuation is also improved. Therefore, a larger maximum operating angle is more preferable. Accordingly, the maximum operating angle is set to a value as large as possible in a range not larger than an operating angle that is slightly smaller than a limit operating angle, that is, an operating angle that causes breakage, etc., of the propeller damper.

In the conventional outboard motor described above, the propeller damper is held by the bushing, and teeth corresponding to a stopper are provided on the rear spacer. The propeller damper deforms in the circumferential direction until the teeth of the rear spacer come into contact with the inner surfaces of the notches of the propeller member. That is, an angle when the teeth of the rear spacer come into contact with the inner surfaces of the notches of the propeller member corresponds to the maximum angle of the relative rotation of the propeller member and the propeller shaft. This means that if the positional relationship between the rear spacer and the bushing in the circumferential direction changes, the maximum angle of the relative rotation of the propeller member and the propeller shaft changes.

However, both of the bushing and the rear spacer are spline-coupled to the propeller shaft. The position of the rear spacer with respect to the propeller shaft in the circumferential direction changes according to variations in dimensions of the spline hole and the spline shaft. Hence, the positional relationship between the rear spacer and the bushing in the circumferential direction changes according to variations in dimensions of the spline hole and the spline shaft. Therefore, the maximum operating angle is set so as not to exceed the limit operating angle by considering maximum values of the variations in dimensions. Therefore, variations in dimensions are a factor that hinders improvement in the performance of the propeller damper.

SUMMARY OF THE INVENTION

In order to overcome the previously unrecognized and unsolved challenges described above, a preferred embodiment of the present invention provides a propeller for a vessel propulsion apparatus to be attached to a propeller shaft extending in the front-rear direction of the vessel. The propeller for a vessel propulsion apparatus includes a bushing that includes a first cylindrical portion surrounding the propeller shaft, and a first protrusion protruding outward from the first cylindrical portion that is integral with the first cylindrical portion, and rotates together with the propeller shaft, a propeller damper made of an elastic material and disposed around the bushing, and an inner cylinder that includes a second cylindrical portion surrounding the bushing via the propeller damper and a second protrusion protruding inward from the second cylindrical portion, and is configured to rotate with respect to the bushing between a noncontact position in which the first protrusion and the second protrusion are separated from each other in the circumferential direction and a contact position in which the first protrusion and the second protrusion come into contact with each other according to elastic deformation of the propeller damper.

With this arrangement, an elastically deformable propeller damper is disposed between the bushing and the inner cylinder. The inner cylinder is disposed at the noncontact position in which the first protrusion of the bushing and the second protrusion of the inner cylinder are separated from each other in the circumferential direction in a state where a torque to rotate the propeller member and the propeller shaft relative to each other is not generated. When a torque to rotate the propeller member and the propeller shaft relative to each other is generated, according to elastic deformation of the propeller damper, the first protrusion of the bushing and the second protrusion of the inner cylinder approach each other in the circumferential direction, and the first protrusion and the second protrusion that correspond to a stopper come into contact with each other. Accordingly, the inner cylinder is disposed at the contact position, and the bushing and the inner cylinder rotate integrally.

Thus, the bushing and the inner cylinder are joined to each other via the propeller damper. The first protrusion that determines the maximum operating angle of the propeller damper is integral and unitary with the first cylindrical portion of the bushing. Therefore, the width of variation in position of the first protrusion with respect to the first cylindrical portion is reduced to be smaller than in the case where the first protrusion is provided on a member separate from the bushing. In other words, the width of variation in position of the first protrusion with respect to the propeller damper is reduced. Therefore, the maximum operating angle is increased, and the performance of the propeller damper is improved.

In a preferred embodiment of the present invention, the propeller preferably further includes a nut to be attached to the propeller shaft at the rear of the bushing, and a rear spacer to be interposed between the bushing and the nut.

With this arrangement, the rear spacer is disposed at the rear of the bushing, and the nut is disposed at the rear of the rear spacer. The bushing is pushed forward via the rear spacer, and accordingly, the bushing is fixed in the front-rear direction with respect to the propeller shaft. The first protrusion that determines the maximum operating angle of the propeller damper is provided not on the rear spacer but on the bushing. Therefore, the rear spacer is simplified in shape than in the case where the first protrusion is provided on the rear spacer.

In a preferred embodiment of the present invention, the first protrusion preferably protrudes outward from the front portion of the first cylindrical portion. The bushing may be inserted into the inner cylinder from the rear side of the inner cylinder, or may be inserted into the inner cylinder from the front side of the inner cylinder.

In the case where the bushing is inserted into the inner cylinder from the front side of the inner cylinder, the inner cylinder preferably includes an annular centering portion that surrounds the bushing. In this case, the bushing and the inner cylinder are restricted from moving relative to each other in the radial direction by the centering portion.

With this arrangement, the centering portion of the inner cylinder is disposed around the bushing. The inner circumferential surface of the centering portion surrounds the outer circumferential surface of the bushing, and is opposed to the outer circumferential surface of the bushing in the radial direction. The relative movements of the bushing and the inner cylinder in the radial direction are restricted by contact of the outer circumferential surface of the bushing with the inner circumferential surface of the centering portion. Accordingly, the amount of eccentricity of the inner cylinder with respect to the bushing is reduced. Therefore, deviation of the elastic deformation of the propeller damper which is caused by eccentricity of the inner cylinder is significantly reduced or prevented.

In a preferred embodiment of the present invention, the inner cylinder preferably further includes an engagement protrusion protruding inward from the second cylindrical portion. The propeller damper preferably includes an engagement groove inside of which the engagement protrusion is disposed.

With this arrangement, the engagement protrusion of the inner cylinder is disposed inside the engagement groove of the propeller damper. A torque applied to the propeller damper is transmitted to the inner cylinder by pushing the side surface of the engagement protrusion in the circumferential direction by the side surface of the engagement groove. Therefore, the torque transmission efficiency is enhanced as compared with the case where a torque is transmitted by friction. Accordingly, a torque is efficiently transmitted between the propeller damper and the inner cylinder.

In a preferred embodiment of the present invention, the engagement groove of the propeller damper preferably includes side surfaces that come into contact with the engagement protrusion of the inner cylinder regardless of the magnitude of a torque to rotate the propeller shaft and the inner cylinder relative to each other.

With this arrangement, the side surfaces of the engagement groove provided on the propeller damper are always in contact with the side surfaces of the engagement protrusion provided on the inner cylinder. Therefore, from the beginning of generation of a torque to rotate the propeller shaft and the inner cylinder relative to each other, the torque is transmitted between the propeller damper and the inner cylinder. Accordingly, the torque is efficiently transmitted between the propeller damper and the inner cylinder.

In a preferred embodiment of the present invention, the width of the second protrusion is preferably not more than the width of the engagement protrusion. Preferably, the width of the second protrusion in the circumferential direction is larger than the width of the engagement protrusion in the circumferential direction. When the width of the second protrusion is larger than the width of the engagement protrusion, the second protrusion has a strength higher than that of the engagement protrusion. Therefore, when the first protrusion of the bushing comes into contact with the second protrusion, a torque is reliably transmitted between the bushing and the inner cylinder.

In a preferred embodiment of the present invention, the engagement groove of the propeller damper preferably includes a first transmitting groove and a second transmitting groove longer in the circumferential direction than the first transmitting groove.

With this arrangement, the first transmitting groove and the second transmitting groove inside of which the engagement protrusion is disposed are provided in the engagement groove of the propeller damper. The width (length in the circumferential direction) of the second transmitting groove is larger than the width of the first transmitting groove, so that when a torque to rotate the propeller member and the propeller shaft relative to each other is not generated, the side surfaces of the second transmitting groove are separated in the circumferential direction from the side surfaces of the engagement protrusion. When the propeller member and the propeller shaft rotate relative to each other, the side surface of the second transmitting groove comes into contact with the side surface of the engagement protrusion and pushes the engagement protrusion in the circumferential direction. Accordingly, from the side surfaces of both the first transmitting groove and second transmitting groove, the torque is transmitted to the engagement protrusion. Therefore, by providing the first transmitting groove and the second transmitting groove, which are different in length in the circumferential direction from each other in the engagement groove, the characteristics (elastic coefficient) of the propeller damper is changed in a phased manner.

In a preferred embodiment of the present invention, the engagement protrusion preferably increases in height toward an inserting direction of the propeller damper into the inner cylinder.

With this arrangement, the propeller damper is inserted into the inner cylinder in the inserting direction (forward or rearward direction). The engagement protrusion provided on the inner cylinder increases in height toward the inserting direction. In other words, the engagement protrusion decreases in height as the inlet of the inner cylinder is approached. Therefore, the propeller damper is easily inserted into and easily pulled out from the inner cylinder.

Accordingly, the time necessary for assembling and maintenance of the propeller is shortened.

In a preferred embodiment of the present invention, the propeller damper is preferably vulcanization bonded to the bushing. The propeller damper may be coupled to the bushing by a fixing method other than vulcanization bonding, such as fixation by press fitting or fixation by using a key and a key groove.

When the propeller damper is vulcanization-bonded to the bushing, the inner surface of the propeller damper is fixed to the outer circumferential surface of the bushing by vulcanization bonding. Therefore, a torque is efficiently transmitted from the bushing to the propeller damper. Further, the propeller damper does not deviate in the circumferential direction from the first protrusion that determines the maximum operating angle of the propeller damper, so that the maximum operating angle is prevented from changing during use of the propeller. Accordingly, the damper characteristics (performance of the propeller damper) is stabilized.

In a preferred embodiment of the present invention, the propeller preferably further includes an outer cylinder that surrounds the inner cylinder and is integral with the inner cylinder, and a plurality of blades extending outward from the outer cylinder.

Another preferred embodiment of the present invention provides a vessel propulsion apparatus including a propeller according to one of the other preferred embodiments of the present invention, a propeller shaft to which the propeller is attached, and a prime mover configured to rotate the propeller shaft.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 8A is a sectional view of the propeller taken along the VIIIA-VIIIA line shown in FIG. 2.

FIG. 8B is a sectional view of the propeller taken along the VIIIB-VIIIB line shown in FIG. 2.

FIG. 8C is a sectional view of the propeller taken along the VIIIC-VIIIC line shown in FIG. 2.

FIG. 9 is a graph showing a relationship between an operating angle and a rotary torque.

FIG. 10A is a sectional view of the propeller taken along the VIIIC-VIIIC line shown in FIG. 2, showing a state in which a first torque is applied to the propeller.

FIG. 10B is a sectional view of the propeller taken along the VIIIA-VIIIA line shown in FIG. 2, showing a state in which a second torque larger than the first torque is applied to the propeller.

DETAILED DESCRIPTION OF THE PREFERRED EMBODIMENTS

First Preferred Embodiment

Figure 1:
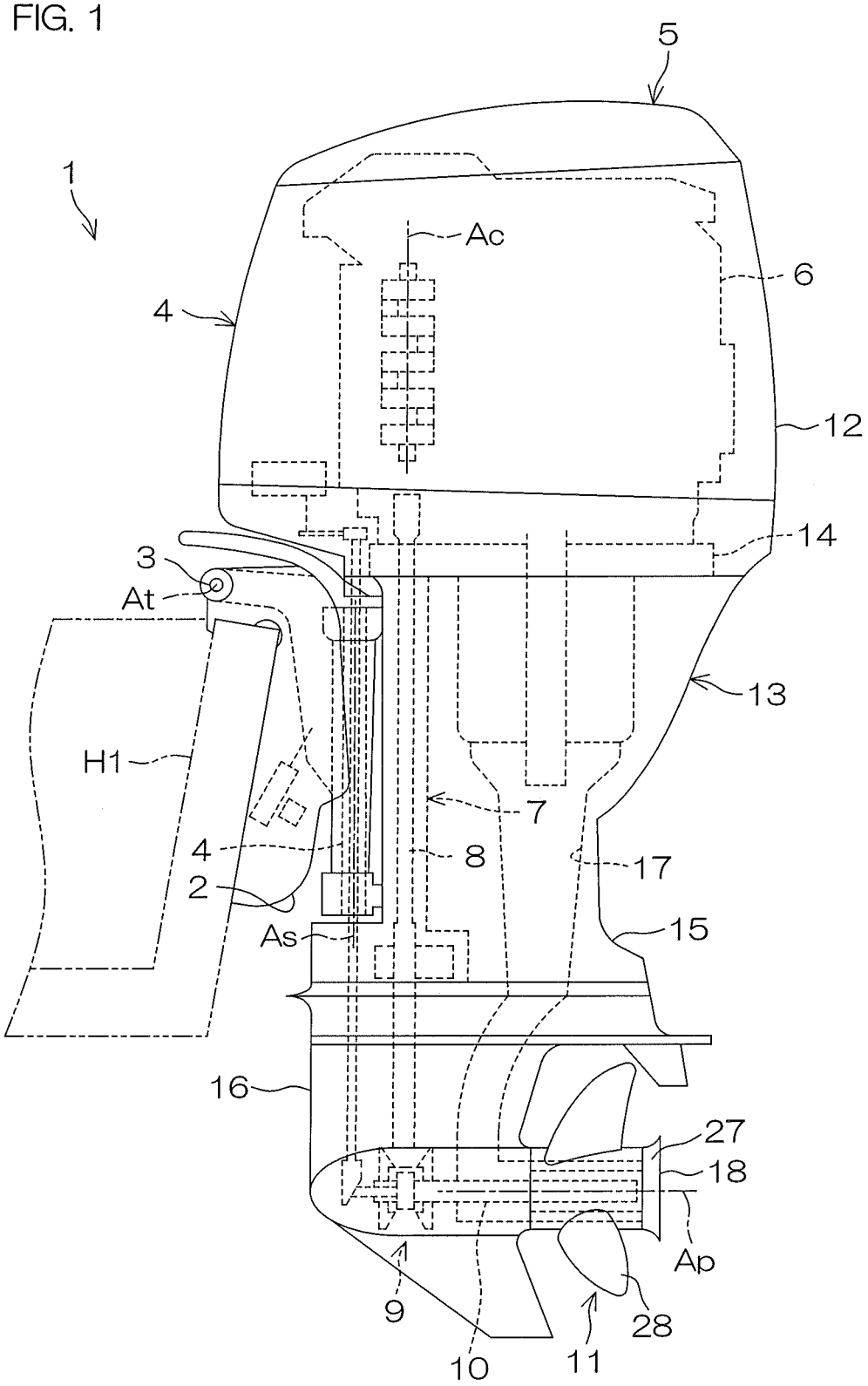
FIG. 1 is a schematic left side view showing a vessel propulsion apparatus according to a first preferred embodiment of the present invention.

As shown in FIG. 1, a vessel propulsion apparatus 1 includes a clamp bracket 2 attachable to the rear portion (stern) of a hull H1, and an outboard motor 5 supported by the clamp bracket 2. The outboard motor 5 is rotatable around a steering axis As (centerline of the steering shaft 4) extending in the up-down direction with respect to the clamp bracket 2, and rotatable around a tilt axis At (centerline of a tilting shaft 3) extending in the left-right direction with respect to the clamp bracket 2.

The outboard motor 5 includes an engine 6 as a non-limiting example of a prime mover that generates power to rotate the propeller 11, and a power transmitting device 7 configured to transmit power of the engine 6 to the propeller 11. The outboard motor 5 further includes a cowling 12 that covers the engine 6 and a casing 13 that houses the power transmitting device 7. The casing 13 includes an exhaust guide 14 disposed below the engine 6, an upper case 15 disposed below the exhaust guide 14, and a lower case 16 disposed below the upper case 15. The exhaust guide 14 as an engine support member supports the engine 6 in a posture in which the rotation axis Ac (rotation axis of the crankshaft) of the engine 6 is vertical.

The power transmitting device 7 includes a drive shaft 8 to which rotation of the engine 6 is transmitted, a forward/reverse switching mechanism 9 to which rotation of the drive shaft 8 is transmitted, and a propeller shaft 10 to which rotation of the forward/reverse switching mechanism 9 is transmitted. Rotation of the engine 6 is transmitted to the propeller shaft 10 via the drive shaft 8 and the forward/reverse switching mechanism 9. The direction of the rotation to be transmitted from the drive shaft 8 to the propeller shaft 10 is switched by the forward/reverse switching mechanism 9. The propeller shaft 10 extends in the front-rear direction inside the lower case 16. The front-rear direction corresponds to the axial direction Da of the propeller shaft 10. The rear end portion of the propeller shaft 10 projects rearward from the lower case 16. The propeller 11 is removably attached to the rear end portion of the propeller shaft 10. The propeller 11 is rotatable around the propeller axis Ap (centerline of the propeller shaft 10) together with the propeller shaft 10.

The outboard motor 5 includes a main exhaust passage 17 that guides exhaust air of the engine 6 to a main exhaust port 18 that opens into the water. The main exhaust passage 17 is defined by the casing 13 and the propeller 11. The main exhaust passage 17 extends downward from the engine 6 to the propeller shaft 10, and then extends rearward along the propeller shaft 10. The main exhaust passage 17 passes through the insides of the exhaust guide 14, the upper case 15, and the lower case 16 and is open at the rear end portion of the propeller 11. The rear end portion of the propeller 11 defines the main exhaust port 18. Exhaust air discharged from the engine 6 is exhausted into the water from the rear end portion of the propeller 11 through the main exhaust passage 17.

Figure 2:
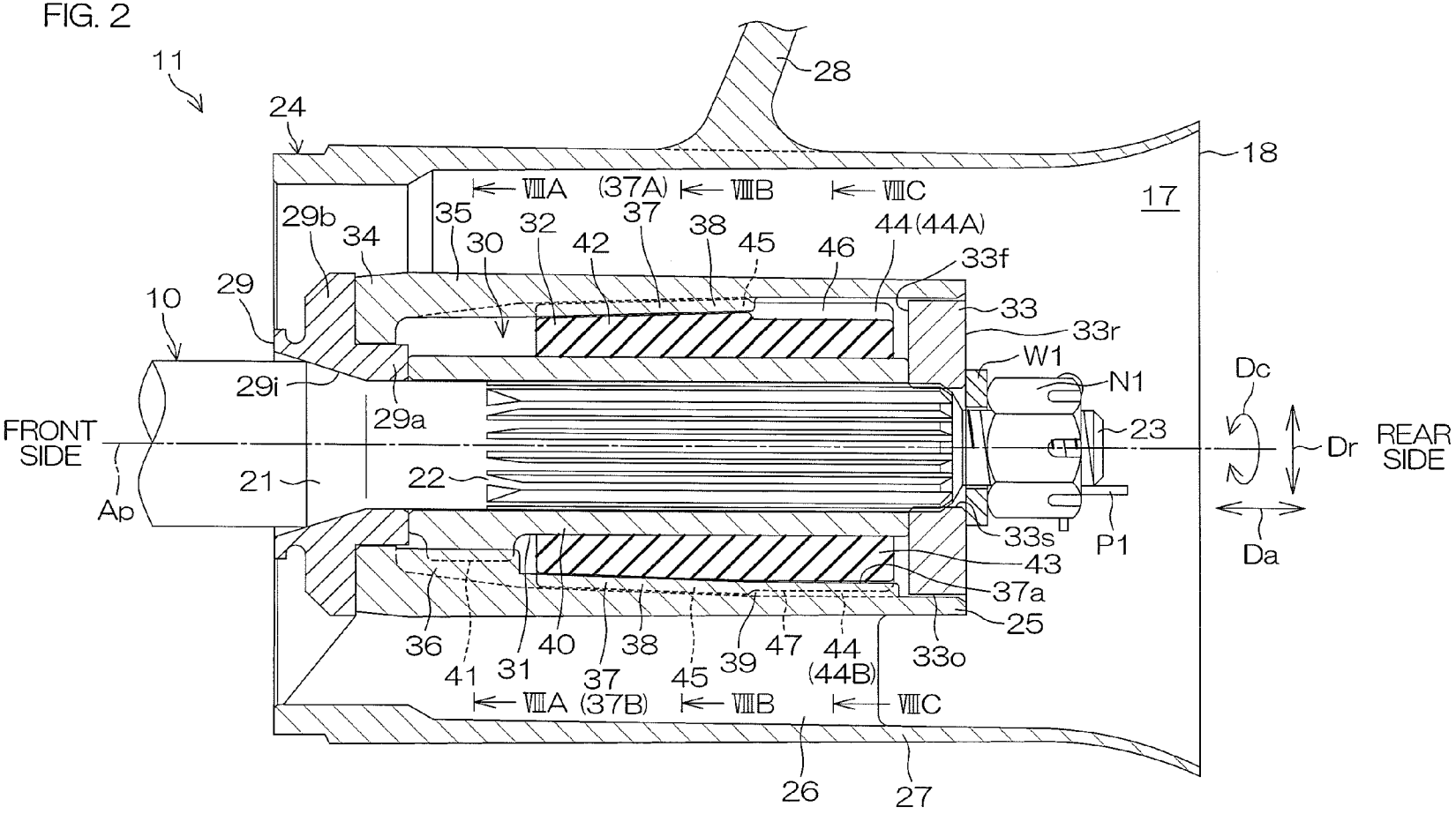
FIG. 2 is a view of a vertical section of a propeller taken along the centerline of the propeller, showing a state in which no rotary torque is applied to the propeller.
Figure 3:
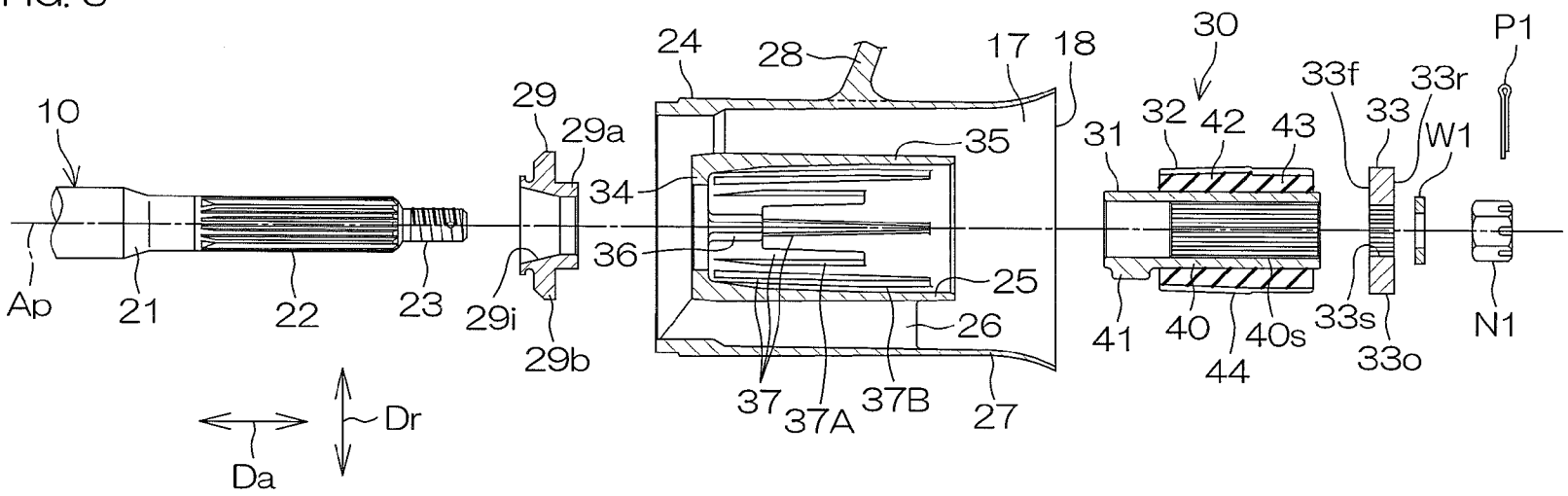
FIG. 3 is an exploded perspective view of the propeller.

As shown in FIG. 3, the propeller 11 includes a tubular propeller member 24 including a plurality of blades 28, a tubular damper unit 30 to be disposed inside the propeller member 24, an annular front spacer 29 to be disposed ahead of the damper unit 30, and a discoid rear spacer 33 to be disposed at the rear of the damper unit 30. The damper unit 30 includes a tubular bushing 31 to be spline-coupled to the propeller shaft 10, and a tubular propeller damper 32 held by the bushing 31. As shown in FIG. 2, the propeller shaft 10 includes a tapered portion 21 to which the front spacer 29 is attached, a spline shaft portion 22 to be spline-coupled to the bushing 31 and the rear spacer 33, and a male threaded portion 23 to which a washer W1 and a nut N1 are attached.

As shown in FIG. 3, the propeller member 24 includes an inner cylinder 25 extending in the axial direction Da, an outer cylinder 27 coaxially surrounding the inner cylinder 25 at a distance in the radial direction Dr of the propeller shaft 10, a plurality of (for example, three) ribs 26 extending from the outer circumferential surface of the inner cylinder 25 to the inner circumferential surface of the outer cylinder 27, and a plurality of blades 28 extending outward from the outer circumferential surface of the outer cylinder 27. The inner cylinder 25, the ribs 26, the outer cylinder 27, and the blades 28 are preferably integral with each other. The outer circumferential surface of the inner cylinder 25 and the inner circumferential surface of the outer cylinder 27 define a portion of the main exhaust passage 17. The rear end portion of the outer cylinder 27 defines the main exhaust port 18.

As shown in FIG. 2, the inner cylinder 25 includes an annular flange portion 34 surrounding the propeller shaft 10, and a second cylindrical portion 35 extending rearward from the outer circumferential portion of the flange portion 34. The damper unit 30 is disposed inside the second cylindrical portion 35. The inner diameter of the rear end of the second cylindrical portion 35 is larger than the outer diameter of the damper unit 30. The inner diameter of the flange portion 34 is smaller than the outer diameter of the damper unit 30. The rear end of the second cylindrical portion 35 defines an inlet from which the damper unit 30 enters the second cylindrical portion 35. The damper unit 30 is inserted into the second cylindrical portion 35 in the forward direction from the rear side of the propeller member 24.

As shown in FIG. 2, the front spacer 29 includes a tapered inner circumferential surface 29*i* along the outer circumferential surface of the tapered portion 21 of the propeller shaft 10, a tubular fitting portion 29*a* fitted in the flange portion 34 of the inner cylinder 25, and an annular support portion 29*b* disposed ahead of the flange portion 34 of the inner cylinder 25. The fitting portion 29*a* is disposed ahead of the bushing 31. The front end surface of the bushing 31 is pressed against the rear end surface of the fitting portion 29*a*. The outer circumferential surface of the fitting portion 29*a* is surrounded by the flange portion 34 of the inner cylinder 25. The support portion 29*b* preferably has a discoid shape, for example, coaxial with the fitting portion 29*a*, and has an outer diameter larger than that of the fitting portion 29*a*. The rear end surface of the support portion 29*b* supports the front end surface of the flange portion 34 of the inner cylinder 25.

As shown in FIG. 2, the rear spacer 33 is spline-coupled to the spline shaft portion 22 of the propeller shaft 10. A plurality of teeth provided on the spline shaft portion 22 engage with a plurality of teeth provided on a spline hole 33*s* of the rear spacer 33. The outer circumferential surface 33*o* of the rear spacer 33 is surrounded by the second cylindrical portion 35 of the inner cylinder 25. The outer circumferential surface 33*o* of the rear spacer 33 is preferably a cylindrical surface with a constant outer diameter. The outer diameter of the rear spacer 33 is smaller than the inner diameter of the second cylindrical portion 35 of the inner cylinder 25, and larger than the inner diameter of the flange portion 34 of the inner cylinder 25. The front end surface 33*f* of the rear spacer 33 is pressed against the rear end surface of the bushing 31, and opposed to the rear end surface of the propeller damper 32 in the axial direction Da at a distance. The front end surface of the washer W1 is pressed against the rear end surface 33*r* of the rear spacer 33.

To attach the propeller 11 to the propeller shaft 10, the damper unit 30 is inserted in advance into the inner cylinder 25 of the propeller member 24. Then, after the front spacer 29 is attached to the propeller shaft 10, the propeller unit including the propeller member 24 and the damper unit 30 integral with each other is spline-coupled to the propeller shaft 10. That is, the spline shaft portion 22 of the propeller shaft 10 is spline-coupled to the bushing 31 of the damper unit 30. Thereafter, the rear spacer 33 is attached to the spline shaft portion 22 of the propeller shaft 10, and the washer W1 and the nut N1 are attached to the male threaded portion 23 of the propeller shaft 10. A pin P1 that prevents the nut N1 from loosening is inserted into a through-hole passing through the nut N1 and the propeller shaft 10 in the radial direction Dr. Accordingly, the propeller 11 is attached to the propeller shaft 10.

Figure 4:
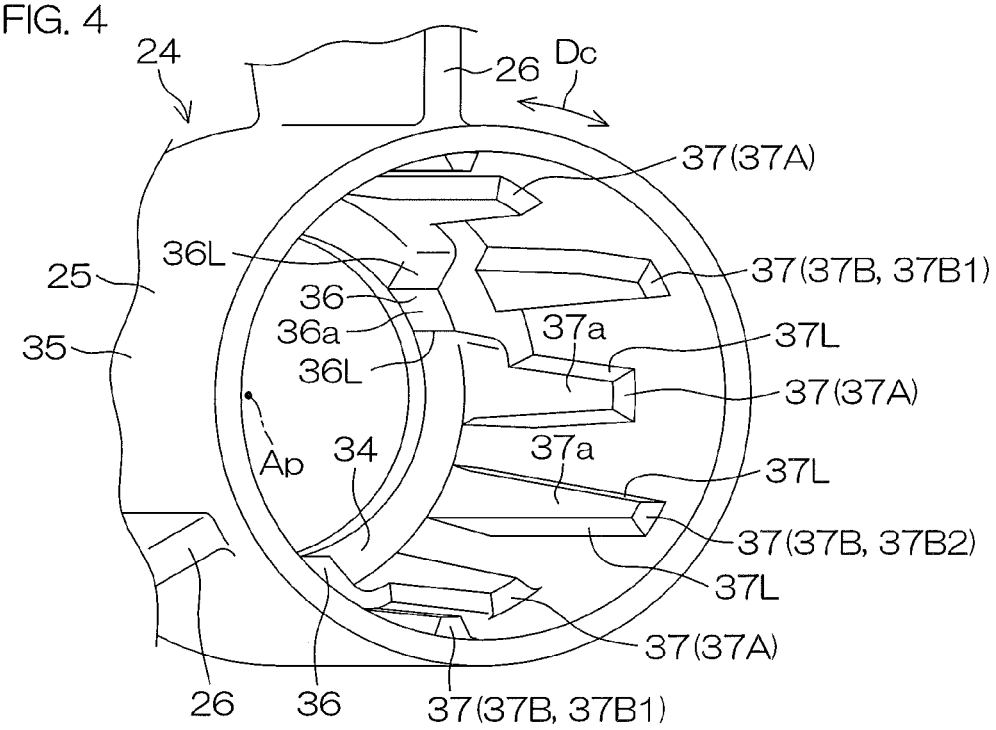
FIG. 4 is a view of an inner cylinder of the propeller, viewed obliquely from the rear side thereof.
Figure 5:
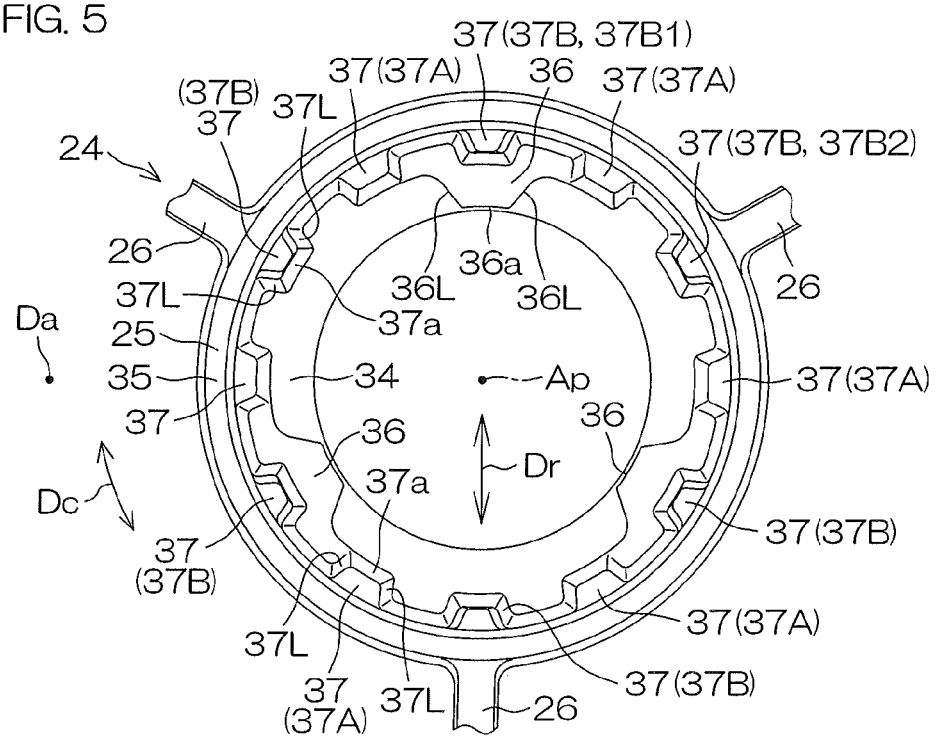
FIG. 5 is a view of the inner cylinder of the propeller, viewed from the rear side thereof.

As shown in FIG. 4 and FIG. 5, the inner cylinder 25 includes, in addition to the flange portion 34 and the second cylindrical portion 35, a plurality of (for example, three) second protrusions 36 protruding inward (direction approaching the propeller axis Ap) from the inner circumferential surface of the second cylindrical portion 35, and a plurality of (for example, twelve) engagement protrusions 37 protruding inward from the inner circumferential surface of the second cylindrical portion 35.

As shown in FIG. 5, the three second protrusions 36 are disposed at equal intervals in, for example, the circumferential direction Dc of the propeller shaft 10. Similarly, the twelve engagement protrusions 37 are disposed at equal intervals in, for example, the circumferential direction Dc. As the inner cylinder 25 is viewed from the rear side thereof, the three engagement protrusions 37 overlap the three second protrusions 36, respectively. The second protrusion 36 and the engagement protrusion 37 overlapping each other are disposed so that the center of the second protrusion 36 in the circumferential direction Dc and the center of the engagement protrusion 37 in the circumferential direction Dc are positioned on the same radius.

Figure 6:
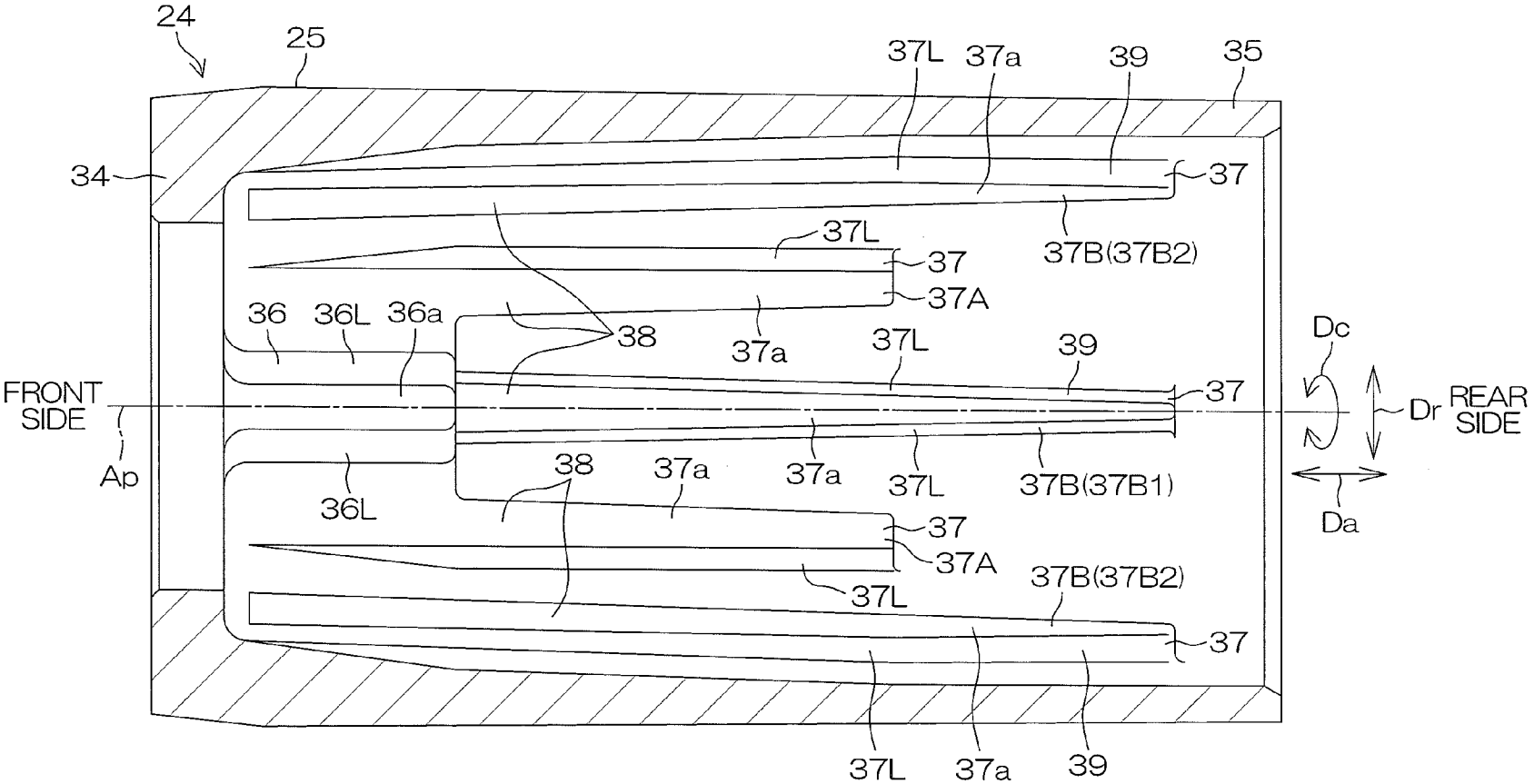
FIG. 6 is a view of a vertical section of the inner cylinder of the propeller taken along the centerline of the propeller.

As shown in FIG. 5, the height (length in the radial direction Dr) of the second protrusion 36 from the inner circumferential surface of the second cylindrical portion 35 is higher than the height of the engagement protrusion 37 from the inner circumferential surface of the second cylindrical portion 35. Further, the width (length in the circumferential direction Dc) of the second protrusion 36 is larger than the width of the engagement protrusion 37. As shown in FIG. 6, the second protrusions 36 and the engagement protrusions 37 extend in the axial direction Da along the inner circumferential surface of the second cylindrical portion 35. The second protrusions 36 extend rearward from the flange portion 34 of the inner cylinder 25. The second protrusions 36 are shorter in the axial direction Da than any of the engagement protrusions 37.

As shown in FIG. 5, the outer surface of the second protrusion 36 includes a pair of side surfaces 36L extending in the axial direction Da and the radial direction Dr, and a tip end surface 36*a* that joins the inner ends of the pair of side surfaces 36L to each other. The pair of side surfaces 36L of the second protrusion 36 preferably have tapering shapes so that the distance between the pair of side surfaces 36L continuously and gradually decreases as the tip end surface 36*a* of the second protrusion 36 is approached. The distance between the pair of side surfaces 36L of the second protrusion 36 is the same at any position in the axial direction Da as long as their positions are the same in the radial direction Dr. The tip end surface 36*a* of the second protrusion 36 preferably has an arc shape coaxial with the inner circumferential surface of the second cylindrical portion 35 of the inner cylinder 25. The height of the second protrusion 36 is the same at any position in the axial direction Da. The width of the tip end surface 36*a* of the second protrusion 36 is the same at any position in the axial direction Da.

As shown in FIG. 6, the twelve engagement protrusions 37 include a plurality of (for example, six) first engagement protrusions 37A, the rear ends of which are disposed more rearward than the second protrusions 36, and a plurality of (for example, six) second engagement protrusions 37B, the rear ends of which are disposed more rearward than the first engagement protrusions 37A. Each second engagement protrusion 37B includes a short protrusion 37B1 disposed at the rear of the second protrusion 36, and a long protrusion 37B2 longer than the short protrusion 37B1. The front end of the short protrusion 37B1 is disposed at the rear of the second protrusion 36. The front end of the long protrusion 37B2 is disposed more forward than the rear end of the second protrusion 36. The first engagement protrusions 37A are shorter in the axial direction Da than any of the second engagement protrusions 37B. As shown in FIG. 5, the twelve engagement protrusions 37 are disposed at equal intervals in, for example, the circumferential direction Dc in the order of the first engagement protrusion 37A, the short protrusion 37B1, and the long protrusion 37B2.

As shown in FIG. 5, the outer surface of the engagement protrusion 37 includes a pair of side surfaces 37L extending in the axial direction Da and the radial direction Dr, and a tip end surface 37*a* that joins the inner ends of the pair of side surfaces 37L to each other. The pair of side surfaces 37L of the engagement protrusion 37 preferably have tapering shapes so that the distance between the pair of side surfaces 37L continuously decreases as the tip end surface 37*a* of the engagement protrusion 37 is approached.

As shown in FIG. 4, the pair of side surfaces 37L of the engagement protrusion 37 are inclined with respect to the propeller axis Ap so that the distance between the pair of side surfaces 37L decreases as the rear end of the engagement protrusion 37 is approached. The pair of side surfaces 37L of the engagement protrusion 37 preferably have tapering shapes so that the distance between the pair of side surfaces 37L continuously decreases as the rear end of the engagement protrusion 37 is approached.

Similarly, the tip end surface 37*a* of the engagement protrusion 37 is preferably tapered so that the width of the tip end surface 37 continuously decreases as the rear end of the engagement protrusion 37 is approached. As shown in FIG. 2, the tip end surface 37*a* of the engagement protrusion 37 is inclined with respect to the propeller axis Ap so as to separate from the propeller axis Ap as the rear end of the engagement protrusion 37 is approached. The engagement protrusion 37 is preferably tapered so that the height of the engagement protrusion 37 continuously decreases as the rear end of the engagement protrusion 37 is approached.

As shown in FIG. 8B, the sectional shapes of the engagement protrusions 37 orthogonal to the axial direction Da are the same as long as their positions in the axial direction Da are the same. Each of the first engagement protrusions 37A and the second engagement protrusions 37B includes a first transmitting protrusion 38 configured to transmit a torque to rotate the propeller shaft 10 and the propeller member 24 relative to each other (hereinafter, referred to as "rotary torque") between the propeller damper 32 and the inner cylinder 25 regardless of the magnitude of the torque. Each second engagement protrusion 37B further includes a second transmitting protrusion 39 (refer to FIG. 8C) configured to transmit the rotary torque between the propeller damper 32 and the inner cylinder 25 when the torque is not less than a first torque T1 (refer to FIG. 9).

Figure 7A:
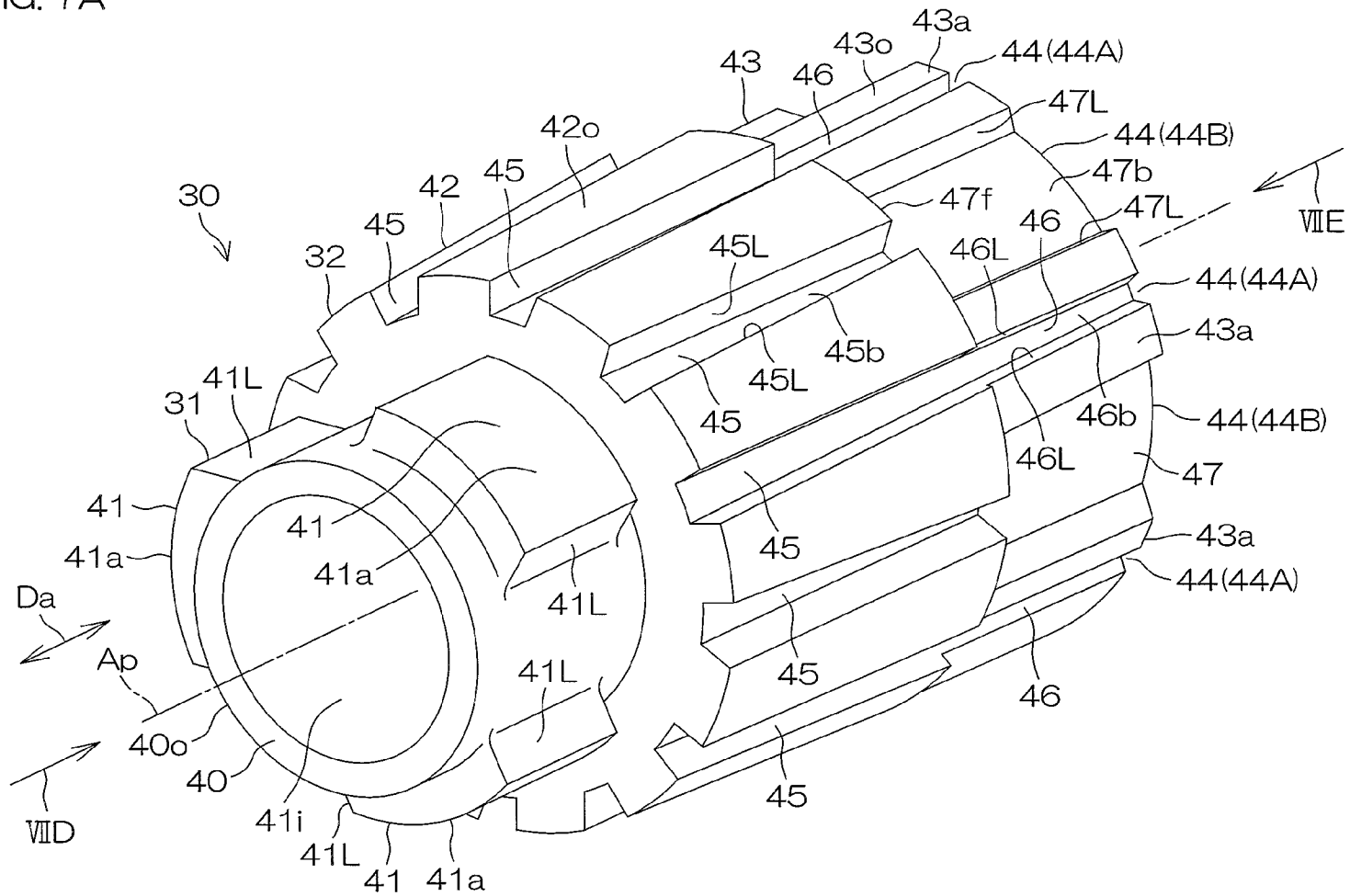
FIG. 7A is a perspective view of a damper unit.
Figure 7B:
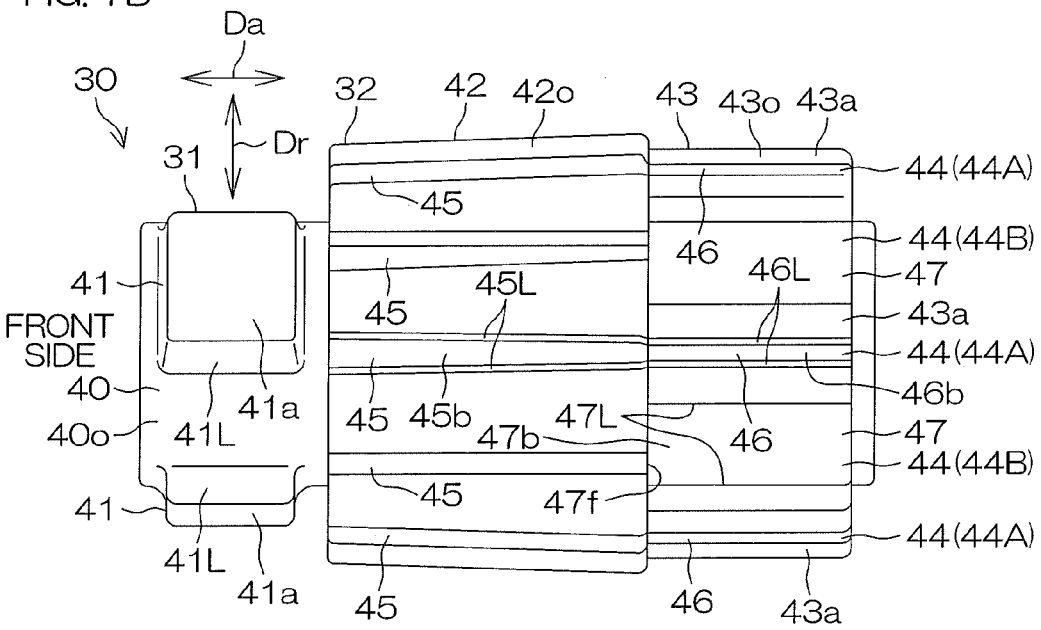
FIG. 7B is a side view of the damper unit.
Figure 7C:
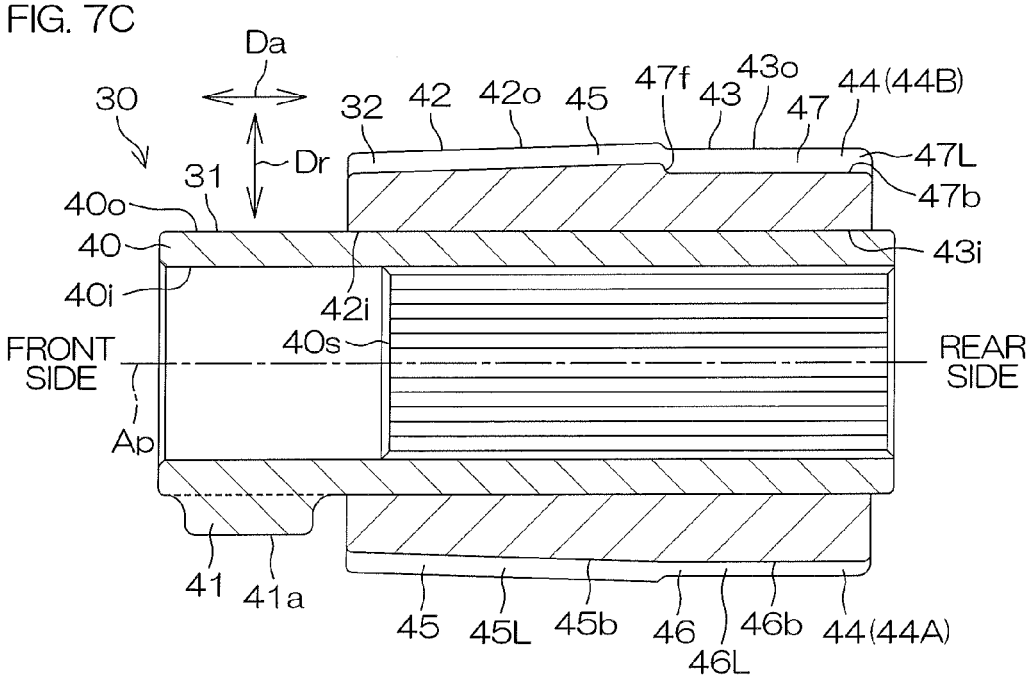
FIG. 7C is a sectional view of the damper unit.

FIG. 7C is a sectional view of the damper unit 30 taken along a vertical plane passing through the propeller axis Ap. As shown in FIG. 7C, the bushing 31 includes a first cylindrical portion 40 extending in the axial direction Da. The first cylindrical portion 40 includes a spline hole 40*s* extending forward from the rear end of the first cylindrical portion 40, an inner circumferential surface 40*i* extending forward from the spline hole 40*s*, and a cylindrical outer circumferential surface 40*o* extending in the axial direction Da. The outer circumferential surface 40*o* and the inner circumferential surface 40*i* of the first cylindrical portion 40 are cylindrical surfaces whose outer diameters are constant. The centerline of the first cylindrical portion 40 (centerline of the bushing 31) is disposed on the propeller axis Ap. The plurality of teeth provided on the spline shaft portion 22 of the propeller shaft 10 are engaged with the plurality of teeth provided on the spline hole 40*s* of the first cylindrical portion 40. Accordingly, the bushing 31 rotates together with the propeller shaft 10.

Figure 7D:
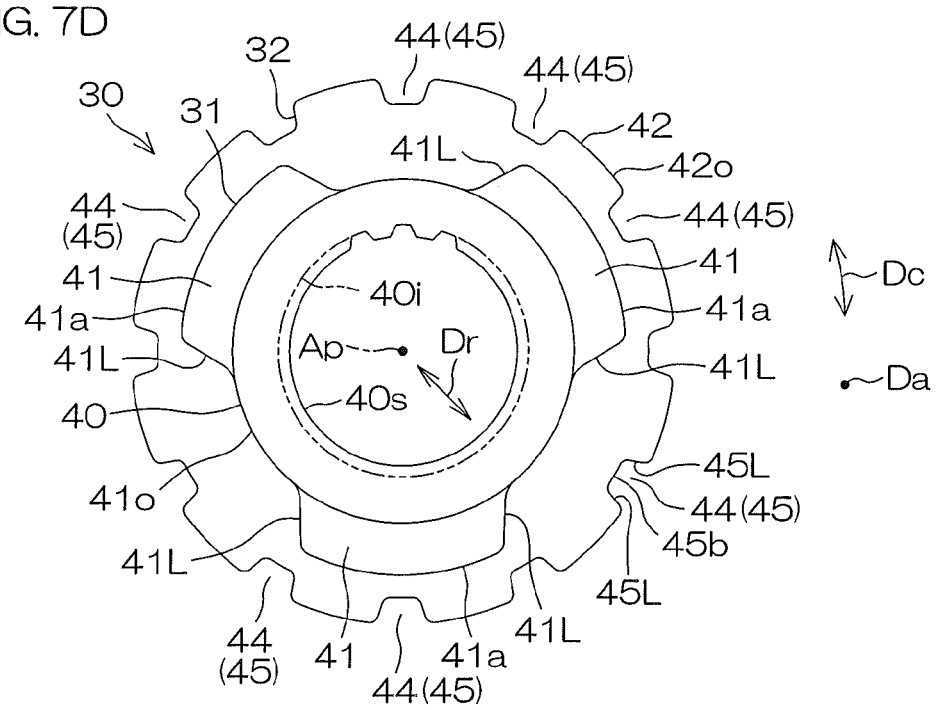
FIG. 7D is a front view of the damper unit, viewed in the direction of the arrow VIID shown in FIG. 7A.

FIG. 7D is a front view of the damper unit 30 viewed from the front side. As shown in FIG. 7D, the bushing 31 includes a plurality of (for example, three) first protrusions 41 extending outward from the first cylindrical portion 40. The three first protrusions 41 are disposed at equal intervals in, for example, the circumferential direction Dc. The first protrusions 41 are integral with the first cylindrical portion 40. Accordingly, the first protrusions 41 rotate together with the first cylindrical portion 40 and the propeller shaft 10. The bushing 31 is made of metal, and higher in strength than the propeller damper 32. As shown in FIG. 7C, the first protrusions 41 extend outward from the front portion of the outer circumferential surface 40*o* of the first cylindrical portion 40. The first protrusions 41 are disposed more rearward than the front end of the first cylindrical portion 40. The first protrusions 41 are disposed more forward than the spline hole 40*s* of the bushing 31. The first protrusions 41 are shorter in the axial direction Da than the first cylindrical portion 40.

As shown in FIG. 7D, the outer surface of the first protrusion 41 of the bushing 31 includes a pair of side surfaces 41L extending in the axial direction Da and the radial direction Dr, and a tip end surface 41*a* that joins the outer ends of the pair of side surfaces 41L to each other. The distance between the pair of side surfaces 41L of the first protrusion 41 is constant at any position in the axial direction Da and the radial direction Dr. The tip end surface 41*a* of the first protrusion 41 preferably has an arc shape coaxial with the outer circumferential surface 40*o* of the first cylindrical portion 40. The height of the first protrusion 41 is the same at any position in the axial direction Da. The height of the first protrusion 41 is larger than the thickness of the first cylindrical portion 40, that is, the distance in the radial direction Dr from the inner circumferential surface 40*i* of the first cylindrical portion 40 to the outer circumferential surface 40*o* of the first cylindrical portion 40. The width of the tip end surface 41*a* of the first protrusion 41 is the same at any position in the axial direction Da.

As shown in FIG. 7C, the propeller damper 32 is preferably made of an elastic material that is elastically deformable such as rubber or resin, for example. The propeller damper 32 surrounds the first cylindrical portion 40 of the bushing 31. The propeller damper 32 is longer in the axial direction Da than the first protrusions 41 of the bushing 31, and shorter in the axial direction Da than the first cylindrical portion 40 of the bushing 31. The propeller damper 32 is disposed at a position more rearward than the first protrusions 41 and more forward than the rear end of the first cylindrical portion 40. The inner circumferential surface 42*i* and the inner circumferential surface 43*i* of the propeller damper 32 are fixed to the outer circumferential surface 40*o* of the first cylindrical portion 40 of the bushing 31 by, for example, vulcanization bonding. The height of the propeller damper 32 is higher than the heights of the first protrusions 41. The outer surface 42*o* and outer surface 43*o* of the propeller damper 32 are disposed more outward than the tip end surfaces 41*a* of the first protrusions 41.

As shown in FIG. 7B, the propeller damper 32 includes a tubular first damper 42 configured to transmit a rotary torque between the bushing 31 and the inner cylinder 25 regardless of the magnitude of the torque, and a tubular second damper 43 configured to transmit a rotary torque between the bushing 31 and the inner cylinder 25 when the torque is not less than the first torque T1 (refer to FIG. 9). The first damper 42 and the second damper 43 are arranged side by side in the axial direction Da so that the first damper 42 is positioned ahead of the second damper 43. The first damper 42 is longer in the axial direction Da than the second damper 43.

As shown in FIG. 7C, the first damper 42 and the second damper 43 define a single integral member. The inner circumferential surface 42*i* of the first damper 42 and the inner circumferential surface 43*i* of the second damper 43 are fixed to the outer circumferential surface 40*o* of the first cylindrical portion 40 of the bushing 31. The outer diameter of the first damper 42 decreases as the front end of the first damper 42 is approached. The outer diameter of the second damper 43 is smaller than the outer diameter (maximum outer diameter) of the rear end of the first damper 42. The outer diameter of the second damper 43 is the same at any position in the axial direction Da.

As shown in FIG. 7A, the propeller damper 32 includes a plurality of (for example, twelve) engagement grooves 44 that engage with the plurality of engagement protrusions 37 provided on the inner cylinder 25. The plurality of engagement grooves 44 include a plurality of (for example, six) first engagement grooves 44A that engage with the plurality of first engagement protrusions 37A provided on the inner cylinder 25, and a plurality of (for example, six) second engagement grooves 44B that engage with the plurality of second engagement protrusions 37B provided on the inner cylinder 25. The twelve engagement grooves 44 are disposed at equal intervals in the circumferential direction Dc so that the first engagement groove 44A and the second engagement groove 44B are alternately arranged.

As shown in FIG. 7A, each first engagement groove 44A includes a first transmitting groove 45 inside of which the first transmitting protrusion 38 of the first engagement protrusion 37A is disposed, and a relief groove 46 disposed more rearward than the rear end of the first engagement protrusion 37A. Each second engagement groove 44B includes a first transmitting groove 45 inside of which the first transmitting protrusion 38 of the second engagement protrusion 37B is disposed, and a second transmitting groove 47 inside of which the second transmitting protrusion 39 of the second engagement protrusion 37B is disposed. The first transmitting grooves 45 are provided on the first damper 42, and the relief grooves 46 and the second transmitting grooves 47 are provided on the second damper 43.

As shown in FIG. 7A, the first transmitting grooves 45, the relief grooves 46, and the second transmitting grooves 47 extend in the axial direction Da along the outer circumferential portion of the propeller damper 32. The front ends of the first transmitting grooves 45 are open at the front end surface of the propeller damper 32. The rear ends of the relief grooves 46 and the second transmitting grooves 47 are open at the rear end surface of the propeller damper 32. The rear ends of the first transmitting grooves 45 provided in the second engagement grooves 44B are open at the front end surfaces 47*f* of the second transmitting grooves 47. The first transmitting groove 45 and the relief groove 46 of the first engagement groove 44A continue toward each other in the axial direction Da. Similarly, the first transmitting groove 45 and the second transmitting groove 47 of the second engagement groove 44B continue toward each other in the axial direction Da. The relief grooves 46 and the second transmitting grooves 47 are shorter in the axial direction Da than the first transmitting grooves 45. The length of the relief groove 46 in the axial direction Da is equal to the length of the second transmitting groove 47 in the axial direction Da.

As shown in FIG. 7A, the inner surface of the first transmitting groove 45 includes a pair of side surfaces 45L extending in the axial direction Da ad the radial direction Dr, and a bottom surface 45*b* that joins the inner ends of the pair of side surfaces 45L to each other. The pair of side surfaces 45L of the first transmitting groove 45 extend inward from the outer surface 42*o* of the first damper 42. The pair of side surfaces 45L of the first transmitting groove 45 preferably have tapering shapes so that the distance between the pair of side surfaces 45L continuously decreases as the propeller axis Ap is approached. The pair of side surfaces 45L of the first transmitting groove 45 preferably have tapering shapes so that the distance between the pair of side surfaces 45L continuously decreases as the rear end of the first transmitting groove 45 is approached. As shown in FIG. 7C, the bottom surface 45*b* of the first transmitting groove 45 is inclined with respect to the propeller axis Ap so as to approach the propeller axis Ap as the front end of the bottom surface 45*b* of the first transmitting groove 45 is approached. The angle of the bottom surface 45*b* of the first transmitting groove 45 with respect to the propeller axis Ap is equal to the angle of the outer surface 42*o* of the first damper 42 with respect to the propeller axis Ap.

As shown in FIG. 7A, the inner surface of the relief groove 46 includes a pair of side surfaces 46L extending in the axial direction Da and the radial direction Dr, and a bottom surface 46*b* that joins the inner ends of the pair of side surfaces 46L to each other. The pair of side surfaces 46L of the relief groove 46 extend inward from the outer surface 43*o* of the second damper 43. The pair of side surfaces 46L of the relief groove 46 preferably have tapering shapes so that the distance between the pair of side surfaces 46L continuously decreases as the propeller axis Ap is approached. The distance between the pair of side surfaces 46L of the relief groove 46 is the same at any position in the axial direction Da as long as their positions are the same in the radial direction Dr. As shown in FIG. 7C, the angle of the bottom surface 46*b* of the relief groove 46 with respect to the propeller axis Ap is equal to the angle of the outer surface 43*o* of the second damper 43 with respect to the propeller axis Ap.

Figure 7E:
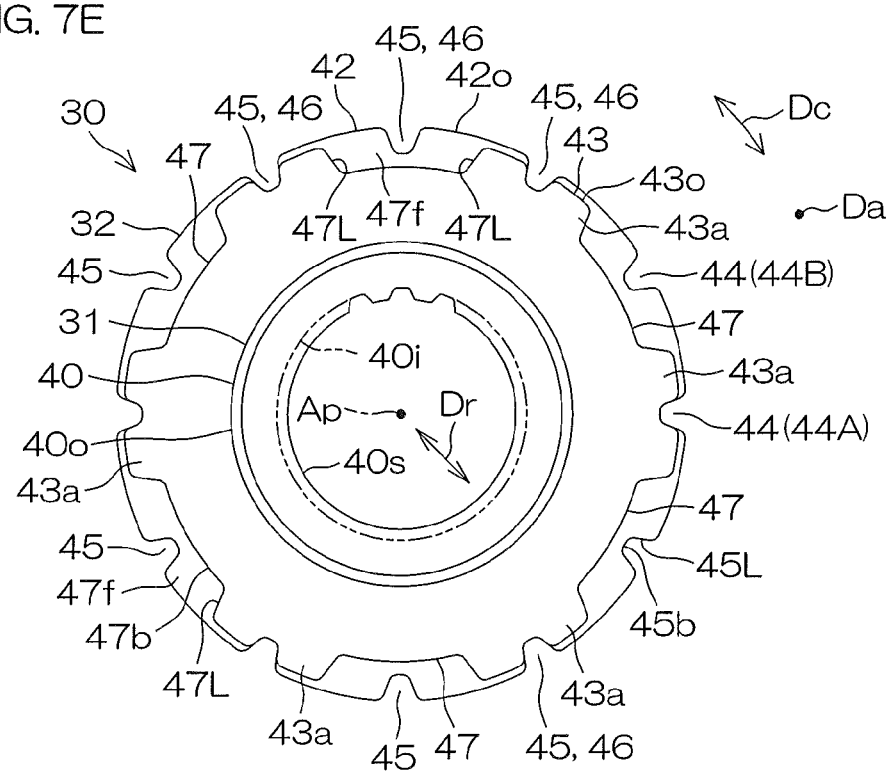
FIG. 7E is a back view of the damper unit, viewed in the direction of the arrow VIIE shown in FIG. 7A.

As shown in FIG. 7A, the inner surface of the second transmitting groove 47 includes a pair of side surfaces 47L extending in the axial direction Da and the radial direction Dr, a bottom surface 47*b* that joins the inner ends of the pair of side surfaces 47L to each other, and a front end surface 47*f* that joins the front ends of the pair of side surfaces 47L to each other. As shown in FIG. 7E, the pair of side surfaces 47L of the second transmitting groove 47 extend rearward from the front end surface 47*f* of the second transmitting groove 47, and extends inward from the outer surface 43*o* of the second damper 43. The pair of side surfaces 47L of the second transmitting groove 47 preferably have tapering shapes so that the distance between the pair of side surfaces 47L continuously decreases as the propeller axis Ap is approached. The distance between the pair of side surfaces 47L of the second transmitting groove 47 is the same at any position in the axial direction Da as long as their positions are the same in the radial direction Dr. The bottom surface 47*b* of the second transmitting groove 47 preferably has an arc shape coaxial with the outer surface 43*o* of the second damper 43. The depth of the second transmitting groove 47 is the same at any position in the axial direction. The width of the bottom surface 47*b* of the second transmitting groove 47 is the same at any position in the axial direction Da.

As shown in FIG. 7E, the six relief grooves 46 and the six second transmitting grooves 47 are disposed at equal intervals in, for example, the circumferential direction Dc so that the relief groove 46 and the second transmitting groove 47 are alternately arranged. The first transmitting groove 45 and the second transmitting groove 47 provided in the same second engagement groove 44B are disposed so that the center of the first transmitting groove 45 in the circumferential direction Dc and the center of the second transmitting groove 5 in the circumferential direction Dc are positioned on the same radius. Similarly, as shown in FIG. 7D, the bushing 31 and the propeller damper 32 are disposed so that the center of the first protrusion 41 in the circumferential direction Dc and the center of the first transmitting groove 45 in the circumferential direction Dc are positioned on the same radius.

As shown in FIG. 7E, the width of the second transmitting groove 47 is larger than the width of the first transmitting groove 45, and larger than the width of the relief groove 46. The depth of the second transmitting groove 47 is larger than the depth of the relief grove 46. The second damper 43 includes a plurality of (for example, six) outer circumferential protrusions 43*a* defined by the plurality of second transmitting grooves 47. The six relief grooves 46 are provided on the six outer circumferential protrusions 43*a*, respectively. The width of the second transmitting groove 47 is larger than the width of the outer circumferential protrusion 43*a*. As shown in FIG. 7B, the second transmitting groove 47 is longer in the axial direction Da than the first protrusion 41 of the bushing 31. The width of the second transmitting groove 47 is smaller than the width of the first protrusion 41.

When fitting the damper unit 30 to the propeller member 24, the damper unit 30 is inserted into the inner cylinder 25 of the propeller member 24 so that the plurality of engagement protrusions 37 provided on the inner cylinder 25 are disposed inside the plurality of engagement grooves 44 provided on the propeller damper 32.

As shown in FIG. 8B, each of the first engagement protrusions 37A and the second engagement protrusions 37B of the inner cylinder 25 includes a first transmitting protrusion 38 to be disposed inside the first transmitting groove 45 of the propeller damper 32. The width of the first transmitting groove 45 before the damper unit 30 is fitted to the propeller member 24 is smaller than the width of the first transmitting protrusion 38. Therefore, when the damper unit 30 is fitted to the propeller member 24, the first transmitting protrusions 38 are press-fitted into the first transmitting grooves 45, and due to elastic deformation of the propeller damper 32, the first transmitting grooves 45 are pushed and widened in the circumferential direction Dc. Accordingly, the pair of side surfaces 37L of the engagement protrusion 37 are pressed against the pair of side surfaces 45L of the first transmitting groove 45, respectively. At this time, the tip end surfaces 37*a* of the engagement protrusions 37 come into contact with the bottom surfaces 45*b* of the first transmitting grooves 45, and the outer surface 42*o* of the first damper 42 comes into contact with the inner circumferential surface of the second cylindrical portion 35 of the inner cylinder 25.

As shown in FIG. 8C, the second engagement protrusion 37B of the inner cylinder 25 includes a second transmitting protrusion 39 to be disposed inside the second transmitting groove 47 of the propeller damper 32. The width of the second transmitting groove 47 is larger than the width of the second transmitting protrusion 39. Therefore, when the damper 30 is fitted to the propeller member 24, the second transmitting protrusions 39 are disposed inside the second transmitting grooves 47 in a state in which the second transmitting protrusions 39 and the second transmitting grooves 47 are separated from each other in the circumferential direction Dc. When no rotary torque is generated, the second transmitting protrusions 39 and the second transmitting grooves 47 are disposed so that the center of the second transmitting protrusion 39 in the circumferential direction Dc and the center of the second transmitting groove 47 in the circumferential direction Dc are positioned on the same radius. At this time, the tip end surfaces 37*a* of the engagement protrusions 37 are separated from the propeller damper 32, and the outer surface 43*o* of the second damper 43 is separated from the inner circumferential surface of the second cylindrical portion 35 of the inner cylinder 25. Thus, when no rotary torque is generated, the bushing 31 and the inner cylinder 25 are disposed at noncontact positions at which the side surfaces 47L of the second transmitting grooves 47 are separated in the circumferential direction Dc from the second transmitting protrusions 39 of the second engagement protrusions 37B.

In addition, as shown in FIG. 8C, even when the damper unit 30 is disposed at a predetermined position (position shown in FIG. 2) inside the propeller member 24, none of the engagement protrusions 37 are disposed in the relief grooves 46. As described below, when the rotary torque exceeds the first torque T1, the outer circumferential protrusions 43*a* of the second damper 43 are pressed against the second transmitting protrusions 39 of the inner cylinder 25. By providing the relief grooves 46 on the outer circumferential protrusions 43*a*, the outer circumferential protrusions 43*a* are lowered in strength and become easy to elastically deform in the circumferential direction Dc. Therefore, the propeller damper 32 efficiently absorbs a shock applied to the propeller damper 32 by elastic deformation of the outer circumferential protrusions 43*a*.

As shown in FIG. 8A, when the damper unit 30 is fitted to the propeller member 24, in a state in which the first protrusions 41 of the bushing 31 and the second protrusions 36 of the inner cylinder 25 are separated in the circumferential direction Dc, each first protrusion 41 is disposed between two second protrusions 36. When no rotary torque is generated, the center of the first protrusion 41 in the circumferential direction Dc is disposed at the center of the two second protrusions 36 in the circumferential direction Dc. At this time, the tip end surfaces 41*a* of the first protrusions 41 of the bushing 31 are separated from the inner cylinder 25, and the tip end surfaces 36*a* of the second protrusions 36 of the inner cylinder 25 are separated from the bushing 31. Thus, when no rotary torque is generated, the bushing 31 and the inner cylinder 25 are disposed so that the side surfaces 47L of the second transmitting grooves 47 of the propeller damper 32 are separated from the second transmitting protrusions 39 of the second engagement protrusions 37B in the circumferential direction Dc, and the first protrusions 41 of the bushing 31 are disposed at noncontact positions separated in the circumferential direction Dc from the second protrusions 36 of the inner cylinder 25.

FIG. 9 is a graph showing the relationship between the operating angle of the propeller damper 32 and the rotary torque to be applied to the propeller damper 32.

As described above, when no rotary torque is generated, the bushing 31 and the second damper 43 are separated from the inner cylinder 25, and the first damper 42 is in contact with the inner cylinder 25. Therefore, at this time, the inner cylinder 25 is elastically supported by the bushing 31 via only the first damper 42.

When a rotary torque is generated, this torque is transmitted between the bushing 31 and the inner cylinder 25 by the first damper 42 via the contact portions between the first transmitting protrusions 38 of the inner cylinder 25 and the first transmitting grooves 45 of the propeller damper 32. Further, the rotary torque is applied to the propeller damper 32, accordingly, the propeller damper 32 elastically deforms so that the outer circumferential portion and the inner circumferential portion of the first damper 42 rotate relative to each other, and the bushing 31 and the inner cylinder 25 rotate relative to each other by an angle corresponding to the elastic deformation amount of the propeller damper 32.

When the magnitude of the rotary torque is in a range less than the first torque T1, this torque is transmitted between the bushing 31 and the inner cylinder 25 by only the first damper 42. As shown in FIG. 9, when the rotary torque reaches the first torque T1, the operating angle of the propeller damper 32 increases to the first operating angle θ1. Accordingly, as shown in FIG. 10A, the bushing 31 and the inner cylinder 25 are disposed at intermediate contact positions at which the side surfaces of the outer circumferential protrusions 43*a* of the second damper 43 (side surfaces 47L of the second transmitting grooves 47) come into contact with the side surfaces 37L of the engagement protrusions 37 of the inner cylinder 25. Therefore, a portion of the rotary torque applied to the damper unit 30 is transmitted between the bushing 31 and the inner cylinder 25 by the second damper 43 via the contact portions between the second transmitting protrusions 39 of the inner cylinder 25 and the second transmitting grooves 47 of the propeller damper 32. That is, the rotary torque is transmitted by both of the first damper 42 and the second damper 43.

When the magnitude of the rotary torque is in a range not less than the first torque T1 and less than the second torque T2, the first protrusions 41 of the bushing 31 are separated from the second protrusions 36 of the inner cylinder 25, so that the torque is transmitted by only the first damper 42 and the second damper 43. When the rotary torque reaches the second torque T2, as shown in FIG. 9, the operating angle of the propeller damper 32 increases to the second operating angle θ2. Accordingly, as shown in FIG. 10B, the bushing 31 and the inner cylinder 25 are disposed at contact positions at which the side surfaces 41L of the first protrusions 41 of the bushing 31 come into contact with the side surfaces 36L of the second protrusions 36 of the inner cylinder 25. Therefore, the rotary torque applied to the damper unit 30 is transmitted between the bushing 31 and the inner cylinder 25 by, in addition to the first damper 42 and the second damper 43, the first protrusions 41 and the second protrusions 36.

When the magnitude of the rotary torque is in a range not less than the second torque T2, the bushing 31 and the inner cylinder 25 are restricted from rotating relative to each other by the contact between the first protrusions 41 and the second protrusions 36, so that as shown in FIG. 9, the operating angle of the propeller damper 32 is kept at the second operating angle θ2. That is, in this range, while the operating angle of the propeller damper 32 is kept at the second operating angle θ2 corresponding to the maximum operating angle, the bushing 31 and the inner cylinder 25 rotate together with each other. Accordingly, the torque is efficiently transmitted between the propeller shaft 10 and the propeller member 24.

As described above, in the first preferred embodiment, the propeller damper 32 that is elastically deformable is disposed between the bushing 31 and the inner cylinder 25. The inner cylinder 25 is disposed at the noncontact position in which the first protrusions 41 of the bushing 31 and the second protrusions 36 of the inner cylinder 25 are separated from each other in the circumferential direction Dc. When a torque to rotate the propeller member 24 and the propeller shaft 10 relative to each other is generated, due to elastic deformation of the propeller damper 32, the first protrusions 41 of the bushing 31 and the second protrusions 36 of the inner cylinder 25 approach each other in the circumferential direction Dc, and the first protrusions 41 and the second protrusions 36 corresponding to a stopper come into contact with each other. Accordingly, the inner cylinder 25 is disposed at the contact position, and the bushing 31 and the inner cylinder 25 rotate integrally.

Thus, the bushing 31 and the inner cylinder 25 are joined to each other via the propeller damper 32. The first protrusions 41 that determine the maximum operating angle of the propeller damper 32 are integral with the first cylindrical portion 40 of the bushing 31. Therefore, the width of variation in position of the first protrusions 41 with respect to the first cylindrical portion 40 is reduced to be smaller than in the case where the first protrusions 41 are provided on a member separate from the bushing 31. In other words, the width of variation in position of the first protrusions 41 with respect to the propeller damper 32 is reduced. Therefore, the maximum operating angle is increased, and performance of the propeller damper 32 is improved.

In the first preferred embodiment of the present invention, the rear spacer 33 is disposed at the rear of the bushing 31, and the nut N1 is disposed at the rear of the rear spacer 33. The bushing 31 is pushed forward via the rear spacer 33, and accordingly, the bushing 31 is fixed in the front-rear direction with respect to the propeller shaft 10. The first protrusions 41 that determine the maximum operating angle of the propeller damper 32 are provided not on the rear spacer 33 but on the bushing 31. Therefore, the shape of the rear spacer 33 is made simpler than in the case where the first protrusions 41 are provided on the rear spacer 33.

In the first preferred embodiment of the present invention, the engagement protrusions 37 of the inner cylinder 25 are disposed inside the engagement grooves 44 of the propeller damper 32. A torque applied to the propeller damper 32 is transmitted to the inner cylinder 25 by pushing the side surfaces 37L of the engagement protrusions 37 in the circumferential direction Dc by the side surfaces of the engagement grooves 44. Therefore, the torque transmission efficiency is made higher than in the case where the torque is transmitted by friction. Accordingly, the torque is efficiently transmitted between the propeller damper 32 and the inner cylinder 25.

In the first preferred embodiment of the present invention, the side surfaces 45L of the first transmitting grooves 45 provided on the propeller damper 32 are always in contact with the side surfaces 37L of the first transmitting protrusions 38 provided on the inner cylinder 25. Therefore, from the beginning of generation of a torque to rotate the propeller shaft 10 and the inner cylinder 25 relative to each other, the torque is transmitted between the propeller damper 32 and the inner cylinder 25. Accordingly, the torque is efficiently transmitted between the propeller damper 32 and the inner cylinder 25.

In the first preferred embodiment of the present invention, the width of the second protrusion 36 in the circumferential direction Dc is larger than the width of the engagement protrusion 37 in the circumferential direction Dc. Since the width of the second protrusion 36 is larger than the width of the engagement protrusion 37, the second protrusion 36 has a strength higher than that of the engagement protrusion 37. Therefore, when the first protrusions of the bushing 31 come into contact with the second protrusions 36 of the inner cylinder 25, the torque is reliably transmitted between the bushing 31 and the inner cylinder 25.

In addition, in the first preferred embodiment of the present invention, the first transmitting groove 45 and the second transmitting groove 47 that are different in length in the circumferential direction Dc from each other are provided in each second engagement groove 44B of the propeller damper 32. The width (length in the circumferential direction Dc) of the second transmitting groove 47 is larger than the width of the first transmitting groove 45, so that when a torque to rotate the propeller member 24 and the propeller shaft 10 relative to each other is not generated, the side surfaces 47L of the second transmitting grooves 47 are separated in the circumferential direction Dc from the side surfaces 37L of the engagement protrusions 37. When the propeller member 24 and the propeller shaft 10 rotate relative to each other, the side surfaces 47L of the second transmitting grooves 47 come into contact with the side surfaces 37L of the engagement protrusions 37 and push the engagement protrusions 37 in the circumferential direction Dc. Accordingly, the torque is transmitted from the side surfaces of both of the first transmitting grooves 45 and the second transmitting grooves 47. Therefore, by providing the first transmitting groove 45 and the second transmitting groove 47, which are different in length in the circumferential direction Dc from each other in each second engagement groove 44B, the characteristics (elastic coefficient) of the propeller damper 32 is changed in a phased manner.

In addition, in the first preferred embodiment of the present invention, the propeller damper 32 is inserted in the inserting direction (forward direction) into the inner cylinder 25. The engagement protrusions 37 provided on the inner cylinder 25 increase in height toward the inserting direction. In other words, the engagement protrusions 37 decrease in height as the inlet of the inner cylinder 25 is approached. Therefore, the propeller damper 32 is easily inserted into and easily pulled out from the inner cylinder 25. Accordingly, the time necessary for assembling and maintenance of the propeller 11 is shortened.

Second Preferred Embodiment

Figure 11:
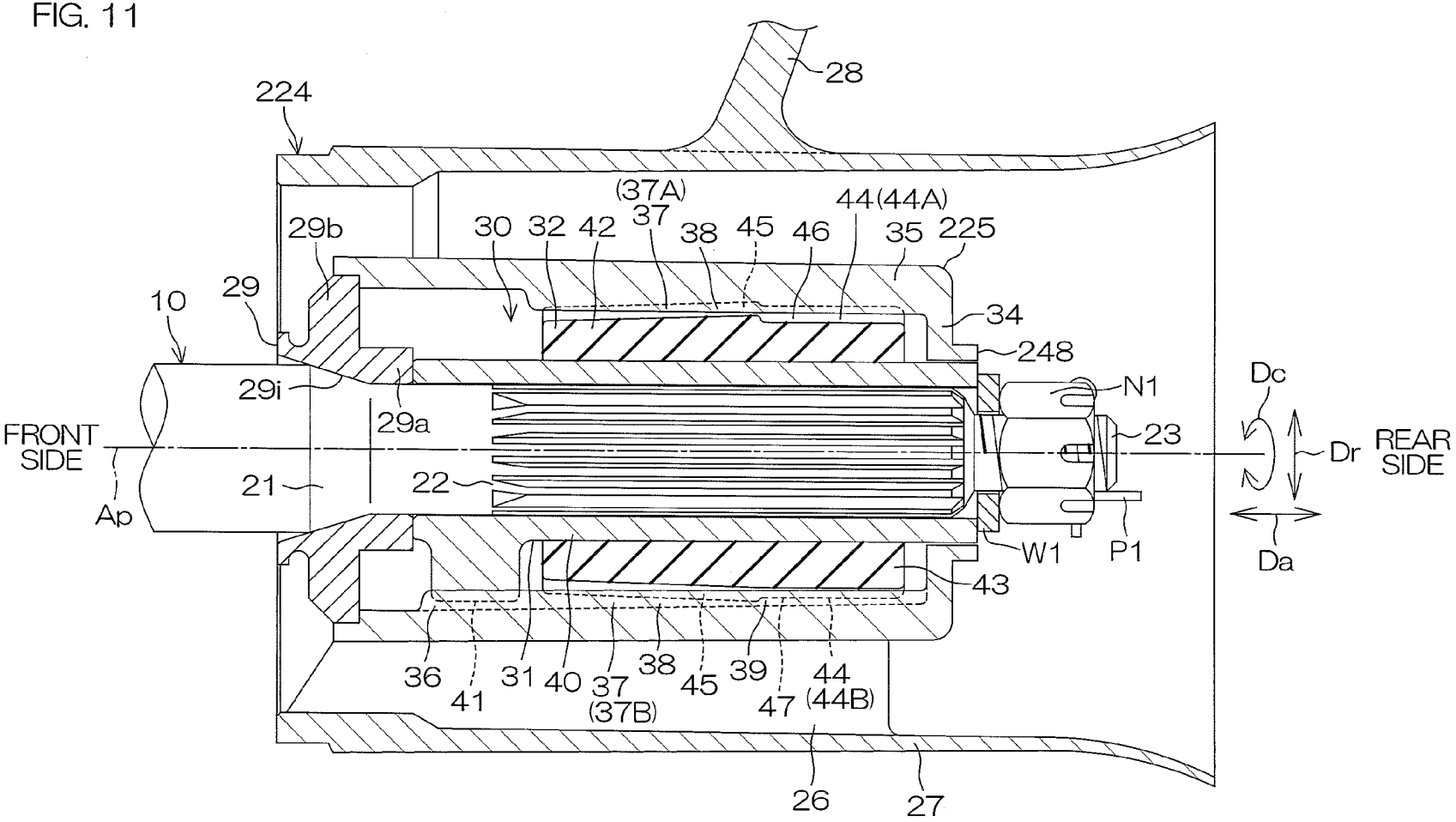
FIG. 11 is a view of a vertical section of a propeller according to a second preferred embodiment of the present invention along the centerline of the propeller, showing a state in which no rotary torque is applied to the propeller.

Next, a second preferred embodiment of the present invention is described. In FIG. 11 described below, the components equivalent to the portions shown in FIG. 1 to FIG. 10B described above are designated by the same reference symbols as in FIG. 1, etc., and description thereof is omitted.

A propeller member 224 according to the second preferred embodiment of the present invention includes, instead of the inner cylinder 25 according to the first preferred embodiment of the present invention, an inner cylinder 225 according to the second preferred embodiment of the present invention. The inner cylinder 225 includes an annular flange portion 34 surrounding the propeller shaft 10, a second cylindrical portion 35 extending forward from the outer circumferential portion of the flange portion 34, and a tubular centering portion 248 extending rearward from the inner circumferential portion of the flange portion 34.

The inner diameter of the front end of the second cylindrical portion 35 is larger than the outer diameter of the damper unit 30. The inner diameter of the flange portion 34 is smaller than the outer diameter of the damper unit 30. At the front end of the second cylindrical portion 35, the damper unit 30 defines an inlet of the inside of the second cylindrical portion 35. The damper unit 30 is inserted rearward into the second cylindrical portion 35 from the front side of the propeller member 224. The first cylindrical portion 40 of the bushing 31 is sandwiched by the front spacer 29 and the washer W1 in the axial direction Da. The support portion 29*b* of the front spacer 29 is disposed inside the second cylindrical portion 35 of the inner cylinder 225. The rear end surface of the support portion 29*b* of the front spacer 29 is supported from the rear by the second cylindrical portion 35 of the inner cylinder 225. The centering portion 248 surrounds the first cylindrical portion 40 of the bushing 31. The centering portion 248 is disposed at the rear of the propeller damper 32.

As described above, in the second preferred embodiment of the present invention, the centering portion 248 of the inner cylinder 225 is disposed around the bushing 31. The inner circumferential surface of the centering portion 248 surrounds the outer circumferential surface 410 of the first cylindrical portion 40 of the bushing 31, and is opposed to the outer circumferential surface 410 of the first cylindrical portion 40 of the bushing 31 in the radial direction Dr. The bushing 31 and the inner cylinder 225 are restricted from moving relative to each other in the radial direction Dr by contact between the outer circumferential surface 410 of the first cylindrical portion 40 of the bushing 31 and the inner circumferential surface of the centering portion 248. Accordingly, the amount of eccentricity of the inner cylinder 225 with respect to the bushing 31 is significantly reduced or prevented. Therefore, deviation of the elastic deformation of the propeller damper 32 which is caused by eccentricity of the inner cylinder 225 is significantly reduced or prevented.

Other Preferred Embodiments

Although first and second preferred embodiments of the present invention have been described above, the present invention is not restricted to the contents of the first and second preferred embodiments and various modifications are possible within the scope of the present invention.

For example, in the preferred embodiments described above, the case where the propeller damper 32 preferably includes the first damper 42 and the second damper 43 is disclosed. However, it is also possible that the propeller damper 32 does not include the second damper 43, but includes only the first damper 42.

In the preferred embodiments described above, the case where the propeller damper 32 preferably has a tubular shape surrounding the entire circumference of the bushing 31 is disclosed. However, it is also possible that the propeller damper 32 does not continue for the entire circumference. That is, the propeller damper 32 preferably includes a plurality of divided bodies divided in the circumferential direction Dc.

In the preferred embodiments of the present invention described above, the case where each first engagement groove 44A provided on the propeller damper 32 preferably includes the first transmitting groove 45 and the relief groove 46 is disclosed. However, each first engagement groove 44A may not include the relief groove 46.

In the first preferred embodiment of the present invention, the case where the first cylindrical portion 40 of the bushing 31 is preferably pushed forward by the rear spacer 33 is disclosed. However, the first cylindrical portion 40 of the bushing 31 may be pushed forward by the washer W1. That is, the rear spacer 33 may be omitted.

In the preferred embodiments of the present invention described above, the case where the first protrusions 41 of the bushing 31 preferably extend outward from the front portion of the first cylindrical portion 40 of the bushing 31 is disclosed. However, the first protrusions 41 of the bushing 31 may extend outward from the rear portion of the first cylindrical portion 40 of the bushing 31. In this case, the inserting direction of the bushing 31 into the inner cylinder 25 may be either the forward direction or the rearward direction.

In the preferred embodiments of the present invention described above, the case where the inner circumferential surface 42*i* and the inner circumferential surface 43*i* of the propeller damper 32 are preferably fixed to the bushing 31 by vulcanization bonding is disclosed. However, the inner circumferential surface of the propeller damper 32 may be fixed to the bushing 31 by a method (for example, press fitting or engagement between convexities and concavities) other than vulcanization bonding.

In the preferred embodiments of the present invention described above, the case where the heights of the engagement protrusions 37 preferably increase toward the inserting direction (forward direction or rearward direction) of the propeller damper 32 into the inner cylinder 25 is disclosed. However, the heights of the engagement protrusions 37 may decrease toward the inserting direction, or may be constant from the front ends of the engagement protrusions 37 to the rear ends of the engagement protrusions 37.

Also, features of two or more of the various preferred embodiments of the present invention described above may be combined.

The present application corresponds to Japanese Application No. 2014-104634 filed on May 20, 2014 in the Japan Patent Office, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A propeller for a vessel propulsion apparatus to be attached to a propeller shaft extending in a front-rear direction of a vessel, the propeller comprising:

a bushing that rotates together with the propeller shaft, the bushing including a first cylindrical portion surrounding the propeller shaft, and a first protrusion protruding outward from the first cylindrical portion that is integral with the first cylindrical portion;

a propeller damper made of an elastic material and disposed around the bushing; and an inner cylinder including a second cylindrical portion surrounding the bushing via the propeller damper, and a second protrusion protruding inward from the second cylindrical portion, the inner cylinder rotates with respect to the bushing between a noncontact position, in which the first protrusion and the second protrusion are separated from each other in a circumferential direction, and a contact position, in which the first protrusion and the second protrusion come into contact with each other according to elastic deformation of the propeller damper; wherein a height of the propeller damper defining a distance from a centerline of the first cylindrical portion to an outermost portion of the propeller damper is higher than a height of the first protrusion defining a distance from the centerline of the first cylindrical portion to an outermost portion of the first protrusion.

2. The propeller for a vessel propulsion apparatus according to claim 1, further comprising:

a nut attached to the propeller shaft at a rear of the bushing; and a rear spacer interposed between the bushing and the nut.

3. The propeller for a vessel propulsion apparatus according to claim 1, wherein the first protrusion protrudes outward from a front portion of the first cylindrical portion; and the bushing is inserted into the inner cylinder from a rear side of the inner cylinder.

4. The propeller for a vessel propulsion apparatus according to claim 1, wherein the first protrusion protrudes outward from a front portion of the first cylindrical portion; and the bushing is inserted into the inner cylinder from a front side of the inner cylinder.

5. The propeller for a vessel propulsion apparatus according to claim 4, wherein the inner cylinder includes an annular centering portion that surrounds the bushing and restricts the bushing and the inner cylinder from moving relative to each other in a radial direction by the annular centering portion.

6. The propeller for a vessel propulsion apparatus according to claim 1, wherein the inner cylinder further includes an engagement protrusion protruding inward from the second cylindrical portion; and the propeller damper includes an engagement groove inside of which the engagement protrusion is disposed.

7. The propeller for a vessel propulsion apparatus according to claim 6, wherein the engagement groove of the propeller damper includes side surfaces that come into contact with the engagement protrusion of the inner cylinder regardless of a magnitude of a torque applied to rotate the propeller shaft and the inner cylinder relative to each other.

8. The propeller for a vessel propulsion apparatus according to claim 6, wherein a width of the second protrusion in the circumferential direction is larger than a width of the engagement protrusion in the circumferential direction.

9. The propeller for a vessel propulsion apparatus according to claim 6, wherein the engagement groove of the propeller damper includes a first transmitting groove and a second transmitting groove longer in the circumferential direction than the first transmitting groove.

10. The propeller for a vessel propulsion apparatus according to claim 6, wherein the engagement protrusion increases in height toward an inserting direction of the propeller damper into the inner cylinder.

11. The propeller for a vessel propulsion apparatus according to claim 1, wherein the propeller damper is vulcanization-bonded to the bushing.

12. The propeller for a vessel propulsion apparatus according to claim 1, further comprising a plurality of blades integral with the inner cylinder.

13. The propeller for a vessel propulsion apparatus according to claim 1, further comprising:

an outer cylinder that surrounds the inner cylinder and is integral with the inner cylinder; and a plurality of blades extending outward from the outer cylinder.

14. A vessel propulsion apparatus comprising:

the propeller according to claim 1;

a propeller shaft to which the propeller is attached; and a prime mover that rotates the propeller shaft.

15. A propeller for a vessel propulsion apparatus to be attached to a propeller shaft extending in a front-rear direction of a vessel, the propeller comprising:

a bushing that rotates together with the propeller shaft, the bushing including a first cylindrical portion surrounding the propeller shaft, and a first protrusion protruding outward from the first cylindrical portion that is integral with the first cylindrical portion;

a propeller damper made of an elastic material and disposed around the bushing; and an inner cylinder surrounding the bushing via the propeller damper, the inner cylinder rotates with respect to the bushing between a noncontact position, in which the first protrusion and the inner cylinder are separated from each other in a circumferential direction, and a contact position, in which the first protrusion and the inner cylinder come into contact with each other according to elastic deformation of the propeller damper; wherein a height of the propeller damper defining a distance from a centerline of the first cylindrical portion to an outermost portion of the propeller damper is higher than a height of the first protrusion defining a distance from the centerline of the first cylindrical portion to an outermost portion of the first protrusion.

16. The propeller for a vessel propulsion apparatus according to claim 15, wherein the bushing is made of metal.

17. The propeller for a vessel propulsion apparatus according to claim 15, wherein the first protrusion protrudes outward from a front portion of the first cylindrical portion; and the bushing is inserted into the inner cylinder from a rear side of the inner cylinder.

18. The propeller for a vessel propulsion apparatus according to claim 15, wherein the first protrusion protrudes outward from a front portion of the first cylindrical portion; and the bushing is inserted into the inner cylinder from a front side of the inner cylinder.

19. The propeller for a vessel propulsion apparatus according to claim 18, wherein the inner cylinder includes an annular centering portion that surrounds the bushing and restricts the bushing and the inner cylinder from moving relative to each other in a radial direction by the annular centering portion.

20. The propeller for a vessel propulsion apparatus according to claim 15, wherein the propeller damper is vulcanization-bonded to the bushing.

21. The propeller for a vessel propulsion apparatus according to claim 15, further comprising a plurality of blades integral with the inner cylinder.

22. The propeller for a vessel propulsion apparatus according to claim 15, further comprising:

an outer cylinder that surrounds the inner cylinder and is integral with the inner cylinder; and a plurality of blades extending outward from the outer cylinder.

23. A vessel propulsion apparatus comprising:

the propeller according to claim 15;

a propeller shaft to which the propeller is attached; and a prime mover that rotates the propeller shaft.

24. A tubular damper unit to be disposed between a propeller shaft of a vessel propulsion apparatus and a propeller member including a plurality of blades provided on an outer surface of the propeller member, the damper unit comprising:

a bushing including a first cylindrical portion and a first protrusion, the first cylindrical portion being made of metal, the first cylindrical portion surrounding the propeller shaft, the first cylindrical portion including a spline hole provided on an inner circumferential surface of the first cylindrical portion, the first protrusion protruding outward from the first cylindrical portion, and the first protrusion being integral with the first cylindrical portion; and a propeller damper made of an elastic material and disposed around the bushing; wherein a height of the propeller damper defining a distance from a centerline of the first cylindrical portion to an outermost portion of the propeller damper is higher than a height of the first protrusion defining a distance from the centerline of the first cylindrical portion to an outermost portion of the first protrusion.

25. The damper unit according to claim 24, wherein the propeller damper is disposed at a position more rearward than the first protrusion and more forward than a rear end of the first cylindrical portion.

26. The damper unit according to claim 24, wherein the propeller damper is fixed to an outer circumferential surface of the first cylindrical portion of the bushing by bonding.

27. The damper unit according to claim 24, wherein the propeller damper is longer in an axial direction of the first cylindrical portion than the first protrusion, and shorter in the axial direction than the first cylindrical portion.

* * * * *